US007789746B2

(12) United States Patent
Ike et al.

(10) Patent No.: US 7,789,746 B2
(45) Date of Patent: Sep. 7, 2010

(54) ROULETTE GAMING MACHINE AND METHOD FOR SELECTING CONSTANT ROTATION PERIOD

(75) Inventors: Hiroatsu Ike, Tokyo (JP); Yoko Aikawa, Tokyo (JP); Kenichi Fujimori, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 476 days.

(21) Appl. No.: 11/471,722

(22) Filed: Jun. 21, 2006

(65) Prior Publication Data

US 2007/0010312 A1 Jan. 11, 2007

(30) Foreign Application Priority Data

Jun. 24, 2005 (JP) ..... P2005-185458

(51) Int. Cl.
*A63F 5/00* (2006.01)

(52) U.S. Cl. ..... 463/17; 273/142 E; 273/142 F; 273/142 H; 273/142 HA

(58) Field of Classification Search ..... 273/142 E, 273/142 F, 142 H, 142 HA; 463/17
See application file for complete search history.

(56) References Cited

U.S. PATENT DOCUMENTS 6,083,105 A * 7/2000 Ronin et al. ..... 463/17
6,520,854 B1 * 2/2003 McNally ..... 463/17
2005/0014550 A1 1/2005 Rhoten
2005/0288089 A1 * 12/2005 Cammegh et al. ..... 463/17

FOREIGN PATENT DOCUMENTS

| | | |
|---|---|---|
| EP | 0 269 331 A2 | 6/1988 |
| GB | 2 356 576 A | 10/2000 |
| GB | 2 385 541 A | 12/2002 |
| GB | 2 395 139 | 5/2004 |
| JP | 2003-334275 | 11/2003 |
| WO | WO 2004/094013 A1 | 11/2004 |

OTHER PUBLICATIONS

Eurasian Search Report Dated Oct. 23, 2006, with partial English Translation.
European Search Report Dated Oct. 13, 2006.

* cited by examiner

*Primary Examiner*—Peter DungBa Vo
*Assistant Examiner*—David Duffy
(74) *Attorney, Agent, or Firm*—McGinn Intellectual Property Law Group, PLLC

(57) ABSTRACT

A roulette gaming machine comprises a roulette board, a ball, a rotatable portion, ball receiving parts, numerals, a driving motor and a main control CPU. The rotatable portion is rotatably provided at a center portion of the roulette board. The ball receiving parts receives the ball and circularly arranged on an inner periphery side of the rotatable portion. The numerals are circularly arranged on an outer periphery side of the rotatable portion so as to be opposed to the ball receiving parts respectively. The driving motor rotates the rotatable portion in a certain direction. The main control CPU selects a drive control pattern. The main control CPU varies a constant speed rotation period for rotating the rotatable portion at a certain rotation speed according to the drive control pattern, and controls the driving unit according to the constant speed rotation period and the certain rotation speed.

11 Claims, 22 Drawing Sheets

FIG.15

ROTATION PERIOD LOTTERY TABLE

99

| VALUE OF RANDOM NUMBER | ROTATION PERIOD | |
|---|---|---|
| | T4 | T6 |
| 0 | 5.104 | 0.172 |
| 1 | 4.986 | 0.308 |
| 2 | 4.832 | 0.444 |
| 3 | 4.698 | 0.578 |
| 4 | 4.562 | 0.714 |
| 5 | 4.428 | 0.848 |
| 6 | 4.292 | 0.984 |
| 7 | 4.156 | 1.120 |
| 8 | 4.022 | 1.254 |
| 9 | 3.886 | 1.390 |
| 10 | 3.752 | 1.524 |
| 11 | 3.616 | 1.660 |
| 12 | 3.480 | 1.796 |
| 13 | 3.346 | 1.930 |
| 14 | 3.210 | 2.066 |
| 15 | 3.076 | 2.200 |
| 16 | 2.940 | 2.336 |
| 17 | 2.804 | 2.472 |
| 18 | 2.670 | 2.606 |
| 19 | 2.534 | 2.742 |
| 20 | 2.400 | 2.876 |
| 21 | 2.264 | 3.012 |
| 22 | 2.128 | 3.148 |
| 23 | 1.994 | 3.282 |
| 24 | 1.858 | 3.418 |
| 25 | 1.724 | 3.552 |
| 26 | 1.588 | 3.688 |
| 27 | 1.452 | 3.842 |
| 28 | 1.318 | 3.958 |
| 29 | 1.182 | 4.094 |
| 30 | 1.046 | 4.230 |
| 31 | 0.912 | 4.364 |
| 32 | 0.776 | 4.500 |
| 33 | 0.642 | 4.634 |
| 34 | 0.506 | 4.770 |
| 35 | 0.372 | 4.904 |
| 36 | 0.236 | 5.040 |
| 37 | 0.100 | 5.176 |

(T4+T6=5.276sec)

ROULETTE GAMING MACHINE AND METHOD FOR SELECTING CONSTANT ROTATION PERIOD

CROSS REFERENCE TO RELATED APPLICATION

This application claims benefit of priority under 35 U.S.C. §119 to Japanese Patent Application No. 2005-185458, filed on Jun. 24, 2005, the entire contents of which are incorporated by reference herein.

BACKGROUND OF THE INVENTION

1. Field of the Invention

The present invention relates to a roulette gaming machine configured to cause a ball to roll on a roulette board and the rolling ball to be received into one of ball receiving parts formed on a rotatable portion. More specifically, the roulette gaming machine causes the rolling ball to be received into one of the ball receiving parts while varying a period for rotating the rotatable portion at a fixed rotation speed according to a lottery result. The present invention further relates to a method for selecting a constant speed rotation period for rotating the rotatable portion.

2. Description of the Related Art

There have been conventionally various roulette gaming machines. When a player bets one or more game media on one or more desired numerals arranged on a roulette board, the roulette gaming machine causes a roulette wheel (rotatable portion) of the roulette board to rotate at a fixed rotation speed and during a fixed period. Then, a ball is launched to the roulette board and then rolls on the roulette board. If the roulette wheel slowly rotates, the rolling ball is received into one of ball receiving grooves (ball receiving parts) formed on the roulette wheel. The roulette gaming machine identifies one numeral (winning number) assigned to the ball receiving groove in which the ball is received, and then determines whether or not the one numeral is equal to one of the one or more desired numerals bet on by the player. If the one numeral is equal to one of the one or more desired numerals, the roulette gaming machine pays out game media corresponding to a dividend amount.

The conventional roulette gaming machine rotates the roulette wheel, in order to vary the winning number as randomly as possible by each roulette game to prevent skilled players from predicting the winning number surely. However, since the roulette wheel is rotated at the fixed rotation speed and during the fixed period in each roulette game, the skilled players can roughly predict a next winning number on the basis of the arrangement of the roulette wheel at the time of launching the ball.

A conventional method for solving the above-described problem is disclosed in Japanese Patent Laid-open Publication No. 2003-334275. In the conventional method, a rotation speed of a roulette wheel is varied according to a sampled random number when a certain time has elapsed since the ball is launched. It is noted that the ball is retrieved from a fixed position of the roulette wheel after the ball has been received in a ball receiving groove formed on the roulette wheel, and then launched from a fixed postion of the roulette board.

However, the conventional method needs a complicated drive control process for a motor to be employed to rotate the roulette wheel because the rotation speed of the roulette wheel is randomly varied in each roulette game. Further, in a case where a pseudo random number generating circuit is employed in the conventional method, if skilled players obtain the previous winning number, the tendency for random numbers to be generated by the pseudo random number generating circuit, and the rotation speed of the roulette wheel corresponding to each random number in each roulette game, they can roughly predict a next winning number because the arrangement of the roulette wheel is reset in each roulette game so that the ball receiving groove to which the previous winning number is assigned is located at the fixed position of the roulette wheel every time the ball is retrieved.

SUMMARY OF THE INVENTION

It is one object of the present invention to provide a roulette gaming machine configured to easily and surely prevent skilled players from roughly predicting a winning number in comparison with the conventional roulette gaming machines.

It is another object of the present invention to provide a method for selecting a constant speed rotation period which is capable of easily and surely preventing skilled players from roughly predicting a winning number in comparison with the conventional method.

In order to achieve the object, the present invention provides a roulette gaming machine comprising: a roulette board; a ball rolling on the roulette board; a rotatable portion formed into an annular shape and rotatably provided at a center portion of the roulette board; a plurality of ball receiving parts configured to receive the ball and circularly-arranged on an inner periphery side of the rotatable portion; a plurality of marks circularly-arranged on an outer periphery side of the rotatable portion so as to be opposed to the plurality of ball receiving parts respectively; a bank passage provided on an outer periphery of the roulette board and on which the ball rolls along a circumferential orbit; a driving unit configured to rotate the rotatable portion in a certain direction; a selecting unit configured to select one drive control pattern among a plurality of drive control patterns for the driving unit; and a rotation period variation control unit configured to vary a constant speed rotation period for rotating the rotatable portion at a certain rotation speed according to the one drive control pattern, and then control the driving unit according to the constant speed rotation period and the certain rotation speed.

According to the present invention, the roulette gaming machine does not need a complicated drive control process for the driving unit because the constant speed rotation period instead of a rotation speed is varied in each roulette game. Therefore, the roulette gaming machine can easily and surely prevent skilled players from roughly predicting a winning number, in comparison with the conventional roulette gaming machine.

In order to achieve the object, the present invention provides a method for selecting a constant speed rotation period for rotating a rotation portion having a plurality of ball receiving parts configured to receive a ball launched by a ball launching unit in a roulette gaming machine, the method comprising the steps of: reading a previous winning number; generating a pseudo random number; selecting a constant speed rotation period according to the generated pseudo random number; and compensating the selected constant speed rotation period according to a positional relation between a ball receiving part to which the previous winning number is assigned and a ball receiving part opposed to the ball launching unit, the positional relation generated when the rotatable portion stops rotating in a previous roulette game.

According to the present invention, even if skilled players obtain the previous winning number, the tendency for pseudo random numbers, and the constant speed rotation period corresponding to each pseudo random number, they cannot roughly predict a next winning number because the tendency for pseudo random numbers is disturbed by chaos caused when a ball rolls on a roulette board in the previous roulette game.

BRIEF DESCRIPTION OF THE DRAWINGS

FIG. 15 is a rotation period lottery table employed when the respective lengths of fourth and sixth periods are selected.

DESCRIPTION OF THE PREFERRED EMBODIMENTS

Hereinafter, one exemplary embodiment of the present invention will be described with reference to FIGS. 1 to 22.

A roulette gaming machine is a gaming machine configured to allow a player to play a roulette game. More specifically, the roulette gaming machine pays out the certain number of game media such as medals to a player when a roulette device selects among a plurality of numerals one numeral on which the player has bet one or more game media.

Figure 1:
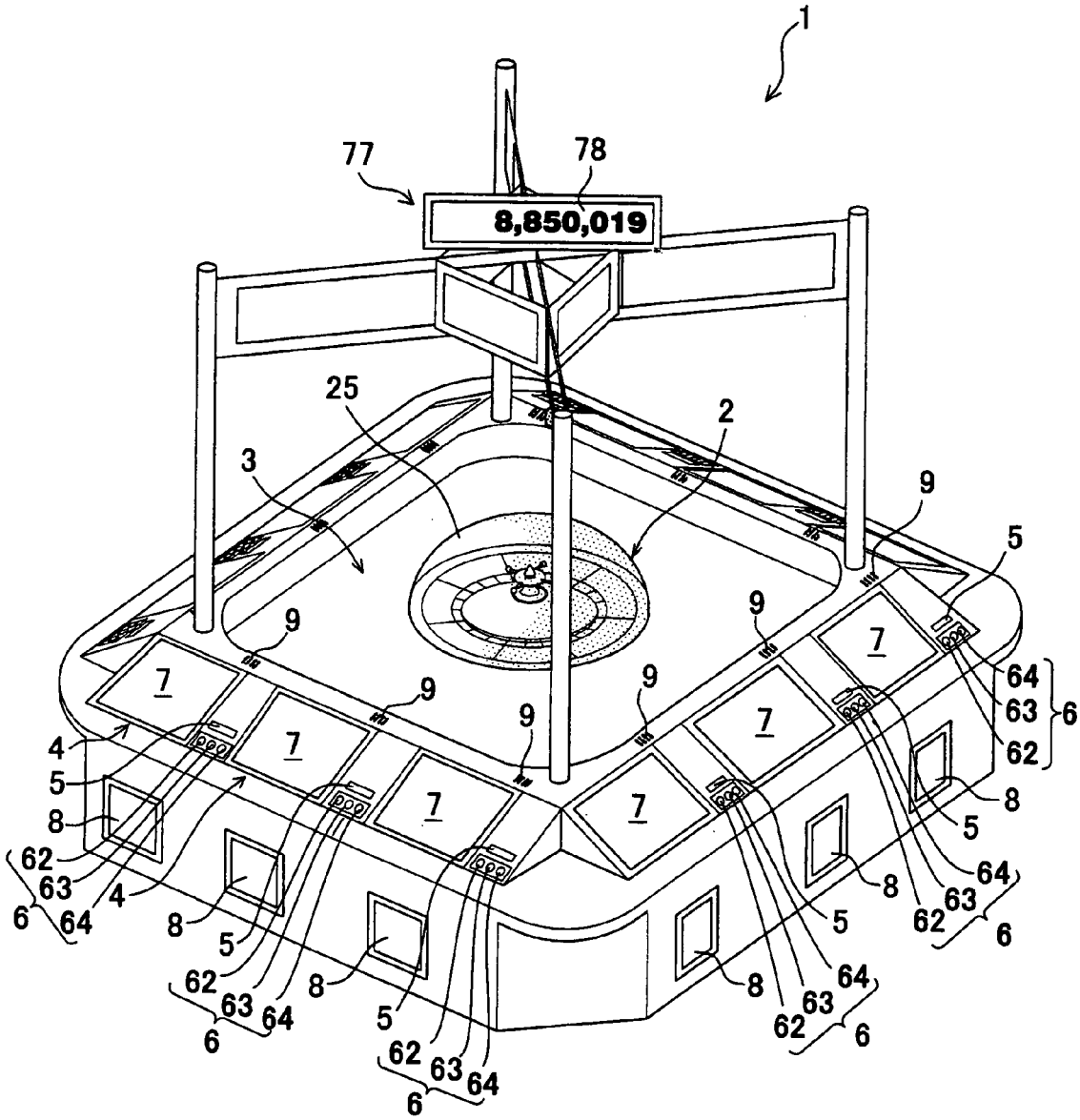
FIG. 1 is a perspective view of a roulette gaming machine according to an exemplary embodiment of the present invention.

As shown in FIG. 1, a roulette gaming machine 1 comprises a roulette device 2, a cabinet 3, a plurality of satellites 4, a plurality of medal payout slots 8, a plurality of speakers 9 and an electronic display unit 77. The cabinet 3 forms a main body of the roulette gaming machine 1. The roulette device 2 is mounted in a center portion of the cabinet 3.

The satellites 4 are mounted on an upper periphery portion of the cabinet 3. It is noted that twelve satellites 4 are mounted on the cabinet 3 in the present exemplary embodiment. Each satellite 4 comprises a medal insertion slot 5, a control portion 6 and an image display device 7. A player can insert one or more game media such as medals or bills into the medal insertion slot 5. The medal insertion slot 5 has a medal sensor 97 (see FIG. 12) therein. The medal sensor 97 detects and counts the game media inserted into the medal insertion slot 5. A player can input various instructions into the roulette gaming machine 1 by using a plurality of control buttons mounted on the control portion 6. The image display device 7 displays various images associated with a roulette game thereon. The roulette game proceeds when a player operates the control portion 6 while watching the image display device 7.

The medal payout slots 8 are mounted on a lower periphery portion of the cabinet 3. Each medal payout slot 8 has a hopper 94 (see FIG. 12) therein. The hopper 94 pays out the certain number of game media via the medal payout slot 8 when a player operates the control portion 6.

The speakers 9 are mounted on the upper periphery portion of the cabinet 3. The roulette gaming machine 1 makes an effective sound via the speakers 9. The satellite 4, the medal payout slot 8 and the speaker 9 make a set in the roulette gaming machine 1. It is noted that twelve sets are mounted on the periphery portion of the cabinet 3 in the present exemplary embodiment.

The electronic display unit 77 is mounted on an upper portion of the cabinet 3. The electronic display unit 77 has a jackpot value display 78 at the top thereof. The jackpot value display 78 displays a jackpot value generated by accumulating a certain percentage (e.g. 0.5%) of the amount of total credits which have been bet by all players participating in the roulette game by means of the satellites 4. All players who participate in the roulette game can have visual contact with the jackpot value display 78 because the jackpot value display 78 is mounted at the top of the electronic display unit 77.

Figure 2:
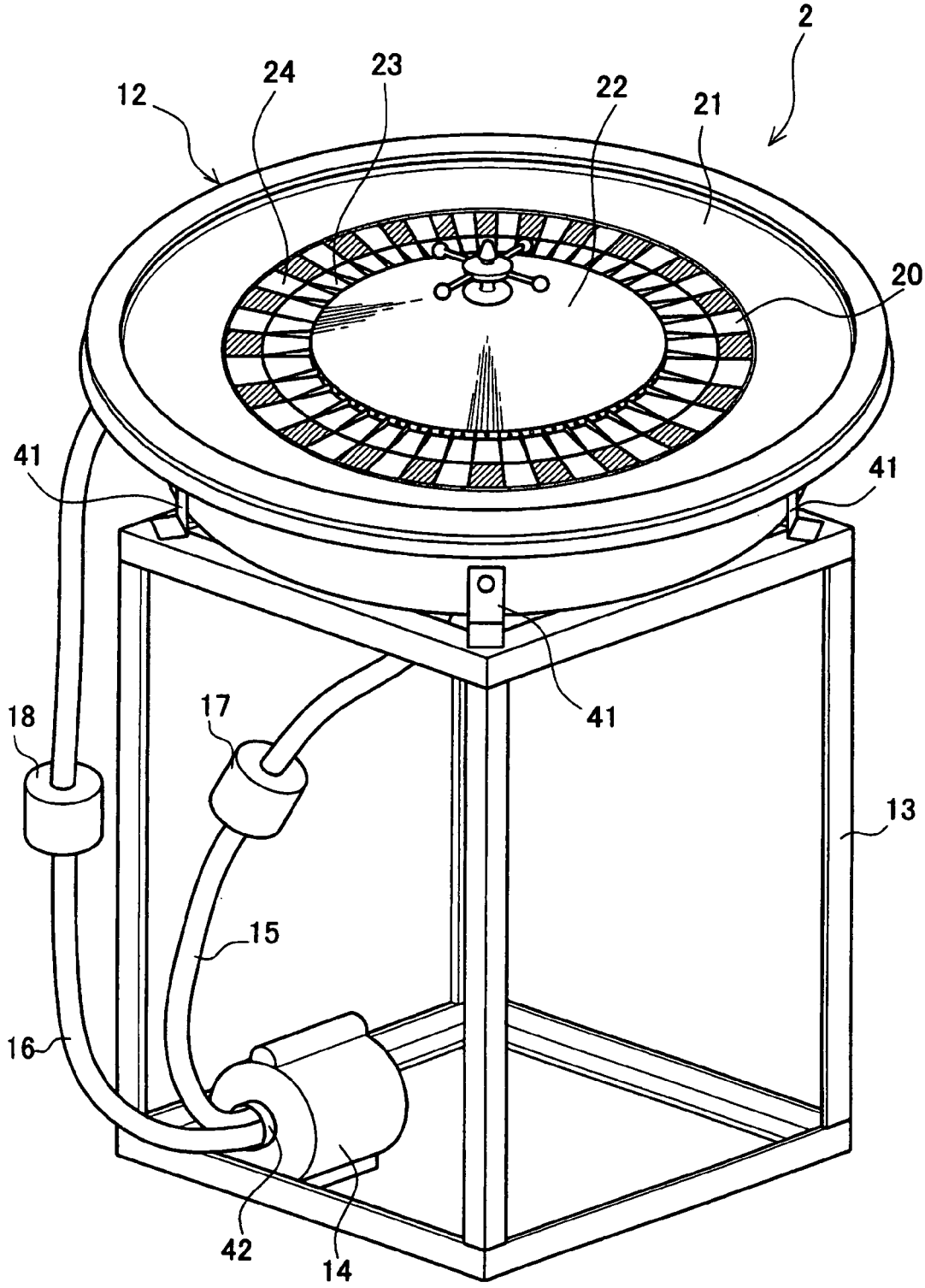
FIG. 2 is a perspective view of a roulette device according to the exemplary embodiment of the present invention.

As shown in FIG. 2, the roulette device 2 comprises a roulette board 12, a support table 13, a compressor 14, air tubes 15, 16, a first valve 17 and a second valve 18. The roulette board 12 has thereon a rolling area on which a ball 11 rolls during a roulette game. The roulette board 12 is supported on the support table 13 in the roulette device 2. The compressor 14 takes in surrounding air and compresses the surrounding air by a constant pressure (1 Mpa in the present exemplary embodiment). Then, the compressor 14 discharges the compressed air to the roulette board 12 via the air tubes 15, 16. The first valve 17 is mounted at a center portion of the air tube 15 and adjusts air pressure within the air tube 15. The second valve 18 is mounted at a center portion of the air tube 16 and adjusts air pressure within the air tube 16.

The roulette board 12 comprises a rotatable portion 20, a rim 21 and a center fixed portion 22. The rotatable portion 20 and the rim 21 form the rolling area. The rim 21 has a bottom panel 21A at a lower portion thereof (see FIG. 4). The center fixed portion 22 substantially forms into a circular cone and is fixedly supported on the bottom panel 21A of the rim 21. The rotatable portion 20 substantially forms into an annular bank and is rotatably supported by the center fixed portion 22. The rotatable portion 20 has an inner periphery surface abutting on an outer periphery surface of the center fixed portion 22. The rim 21 substantially forms into an annular bank and is fixedly supported on the support table 13. The rim 21 has an inner periphery surface abutting on an outer periphery surface of the rotatable portion 20. The rotatable portion 20 has a plurality of concave ball receiving parts 23 (thirty-eight ball receiving parts in the present exemplary embodiment) arranged on an inner periphery side of an upper surface thereof and along a circumferential direction thereof. The ball receiving parts 23 are adjacent to one another via party walls 23A each which substantially forms into a triangle (see FIG. 6). The rotatable portion 20 further has a number indication part 24 arranged on the upper surface thereof and along a circumferential direction thereof so as to surround the ball receiving parts 23. In the number indication part 24, numerals "0", "00", "1" to "36" are respectively arranged to areas which are opposed to the ball receiving parts 23. Each of the areas is painted red or black.

The rectangular support table 13 is made by assembling a plurality of metal columns one another. The support table 13 fixedly supports the roulette board 12 by means of fixing tools 41 mounted on four corners of an upper portion thereof. The roulette board 12 is thereby located at a certain height.

The compressor 14 is arranged within the support table 13. The compressor 14 has a discharge nozzle 42 for discharging the compressed air. The discharge nozzle 42 is connected to the air tubes 15, 16. The air tubes 15, 16 are respectively connected to a first outlet portion 33 and second outlet portions 36 mounted on the roulette board 12 (see FIG. 3).

The first and second valves 17, 18 are magnetic valves and capable of controlling an opening valve time. The first and second valves 17, 18 are connected to a main control CPU 80 (see FIG. 11). The main control CPU 80 controls the opening valve time according to a program stored in a ROM 81 in advance. The main control CPU 80 can thereby adjusts air pressure to be discharged from the first and second outlet portions 33, 36 via the first and second valves 17, 18, which causes the ball 11 to roll on the roulette board 12 during a certain time.

When the roulette device 2 is installed in the roulette gaming machine 1, the roulette board 12 is covered with a semi-spherical cover member 25 which is made of transparent acrylic (see FIG. 1). The cover member 25 prevents the rolling ball 11 from getting out of the roulette board 12 during a roulette game. The cover member 25 further prevents foreign matter from getting into the roulette board 12, which leads to prevent deceptive acts.

More specifically, the configuration of the roulette board 12 will be described with reference to FIGS. 3 to 5.

The roulette board 12 comprises the rotatable portion 20, the rim 21 and the center fixed portion 22. As shown in FIG. 4, the rotatable portion 20 is rotatably supported by the center fixed portion 22 via a cross ball bearing 26. The rotatable portion 20 is rotated by a driving motor 34 mounted in the roulette board 12, at a certain speed (e.g. 5.005 rpm or 16.683 rpm) and in a certain direction (e.g. an anticlockwise direction) with respect to the rim 21. The rotation of the rotatable portion 20 starts at a certain time before the ball 11 will be launched from one of the ball receiving parts 23 and finishes at a certain time after the ball 11 has been received in one of the ball receiving parts 23.

In a case where the ball 11 has been received in the ball receiving part 23, the ball receiving part 23 is located at the front of the first outlet portion 33 by rotating the rotatable portion 20, so that the ball 11 is launched from the ball receiving part 23. Also, in a case where the ball 11 has been received in the ball receiving part 23, the ball receiving part 23 passes the front of one of ball detecting sensors 44 mounted on the center fixed portion 22 by rotating the rotatable portion 20, so that the ball receiving part 23 is detected by one of the ball detecting sensors 44. A rotation driving mechanism and rotating operation of the rotatable portion 20 will be described later.

The rim 21 has a bank passage 29 around an outer periphery portion thereof. The bank passage 29 guides the rolling ball 11 in a circumferential direction of the rim 21, against centrifugal force acting on the rolling ball 11. The ball 11 thereby rolls on a circular orbit. The bank passage 29 is formed by a guide wall 30 and an upper wall 31. The guide wall 30 vertically extends from the outer periphery portion of the rim 21. The upper wall 31 inward and horizontally extends from an upper end portion of the guide wall 30. The upper wall 31 prevents the rolling ball 11 from getting out of the bank passage 29.

When the ball 11 is launched from one of the ball receiving parts 23, the launched ball 11 starts to roll by air discharged from the second outlet portions 36. Then, the ball 11 rolls on the bank passage 29 while accelerating in the circumferential direction of the rim 21 by the discharged air. In this state, when discharging air from the second outlet portions 36 is stopped, the rolling ball 11 decelerates to lose the centrifugal force acting thereon. Then, the ball 11 rolls down a first slope surface 28B of the rim 21 to reach the rotating rotatable portion 20. Further, the ball 11 rolls on the number indication part 24 of the rotating rotatable portion 20 and then is received into one of the ball receiving parts 23. One numeral arranged to the area opposed to the one of ball receiving parts 23 becomes a winning number.

Figure 4:
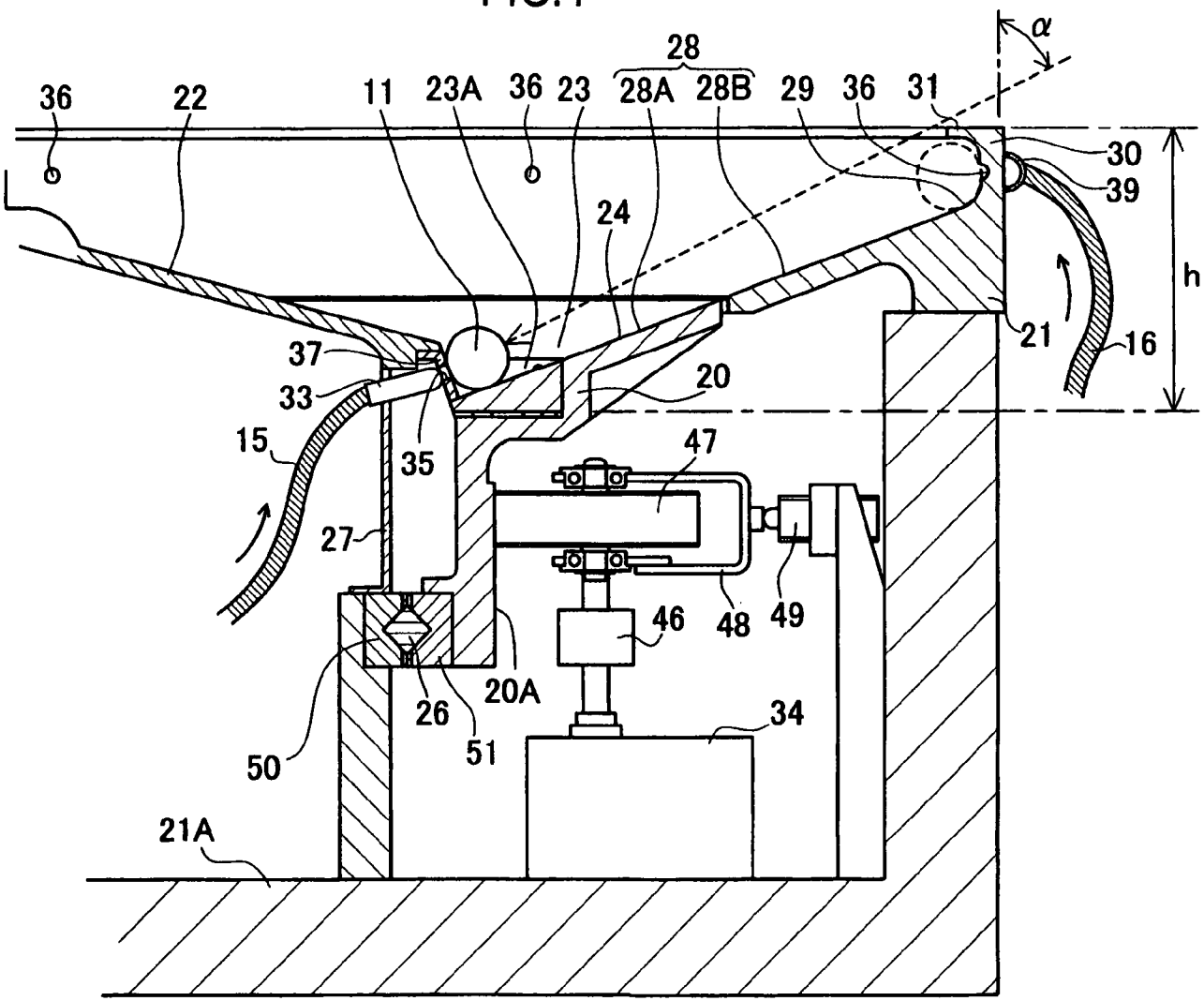
FIG. 4 is a cross-sectional view of the roulette device along the line IV-IV shown in FIG. 3.
Figure 5:
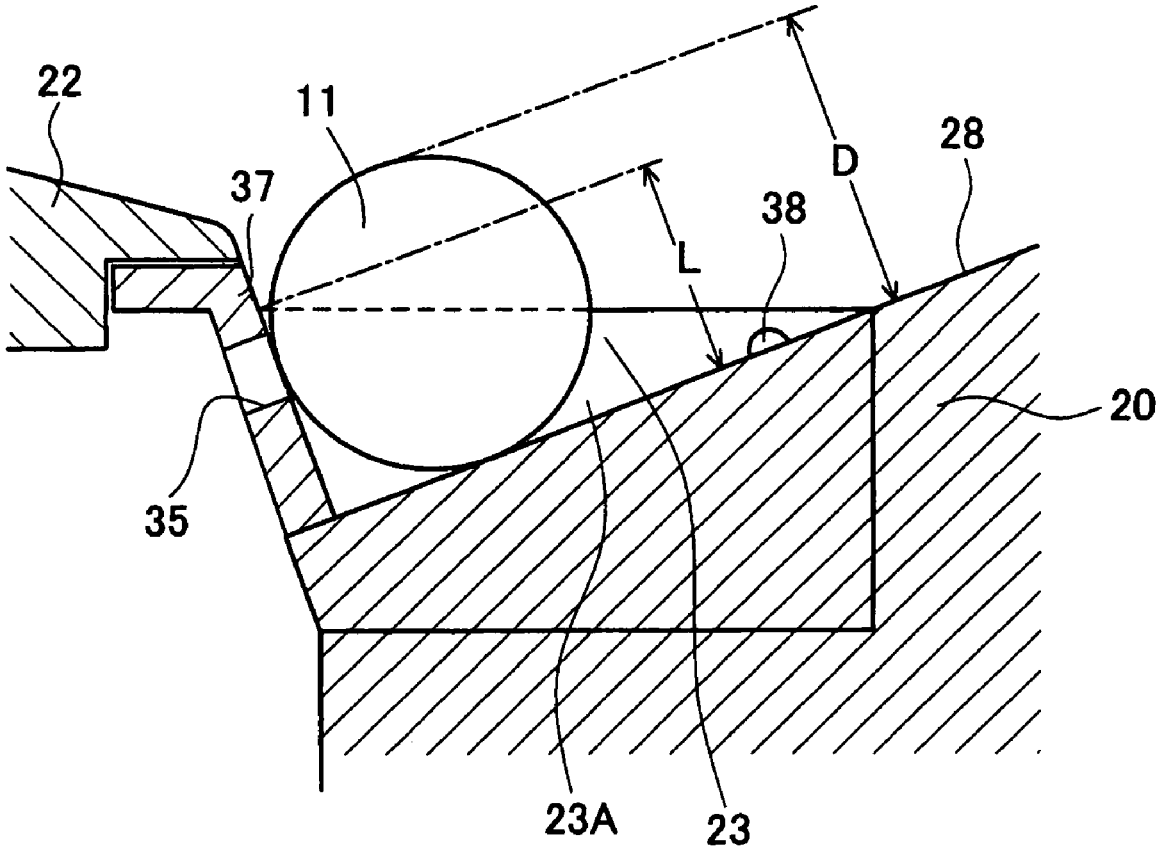
FIG. 5 is an enlarged cross-sectional view of a ball receiving part in the roulette device shown in FIG. 4.

As shown in FIG. 5, the value of the depth L of the ball receiving part 23 with respect to a bottom surface of the ball receiving part 23 is smaller than the value of the diameter D of the ball 11. This allows participating players to easily identify the ball 11 received in the ball receiving part 23 from every angle, during a roulette game. In the number indication part 24, a second slope surface (bottom surface) 28A inward extends from the first slope surface 28B of the rim 21 (see FIG. 4). An oblique angle $\alpha$ of the first slope surface 28B is equal to that of the second surface 28A. This also allows the participating players to easily identify the ball 11 received in the ball receiving part 23 from every angle, during the roulette game. The first and second slope surfaces 28B, 28A form a whole slope surface 28. Thereby, the ball 11 is launched and smoothly rolls toward the bank passage 29 on the whole slope surface 28.

The ball receiving parts 23 are detachably fixed to the rotatable portion 20 by means of screws 38 so that maintenance of respective ball receiving parts 23 is easily conducted. The screws 38 are driven into the bottom surfaces of all the ball receiving parts 23, respectively. Here, it would appear that a convex upper portion of each screw 38 interferes with entry of the ball 11 into the ball receiving part 23, which would influence probability for the entry of the ball 11 into the ball receiving part 23. However, the interference occurs with equal probability in all the ball receiving parts 23, which does not influence the probability while increasing diversity of ball trajectories.

Next, the configuration of the first outlet portion 33 will be described with reference to FIGS. 3 to 6.

Figure 3:
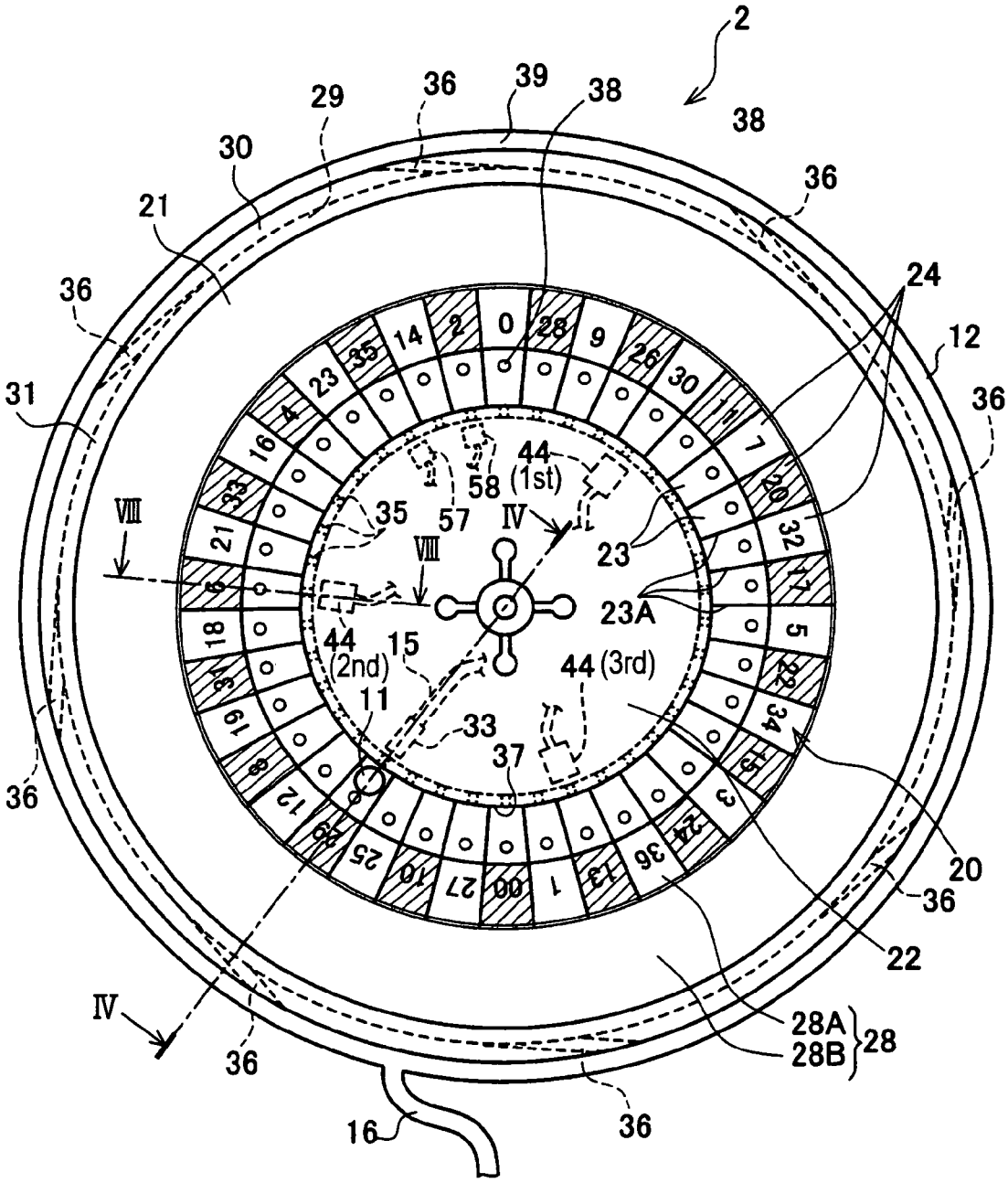
FIG. 3 is a plane view of the roulette device according to the exemplary embodiment of the present invention.

As shown in FIGS. 3, 4, the first outlet portion 33 is fixedly supported by a clamping plate 27 mounted at an outer periphery edge of the center fixed portion 22 which is opposed to the rotatable portion 20. The compressor 14 generates compressed air and feeds the compressed air into the roulette board 12 through the air tube 15 and the first outlet portion 33.

Figure 6:
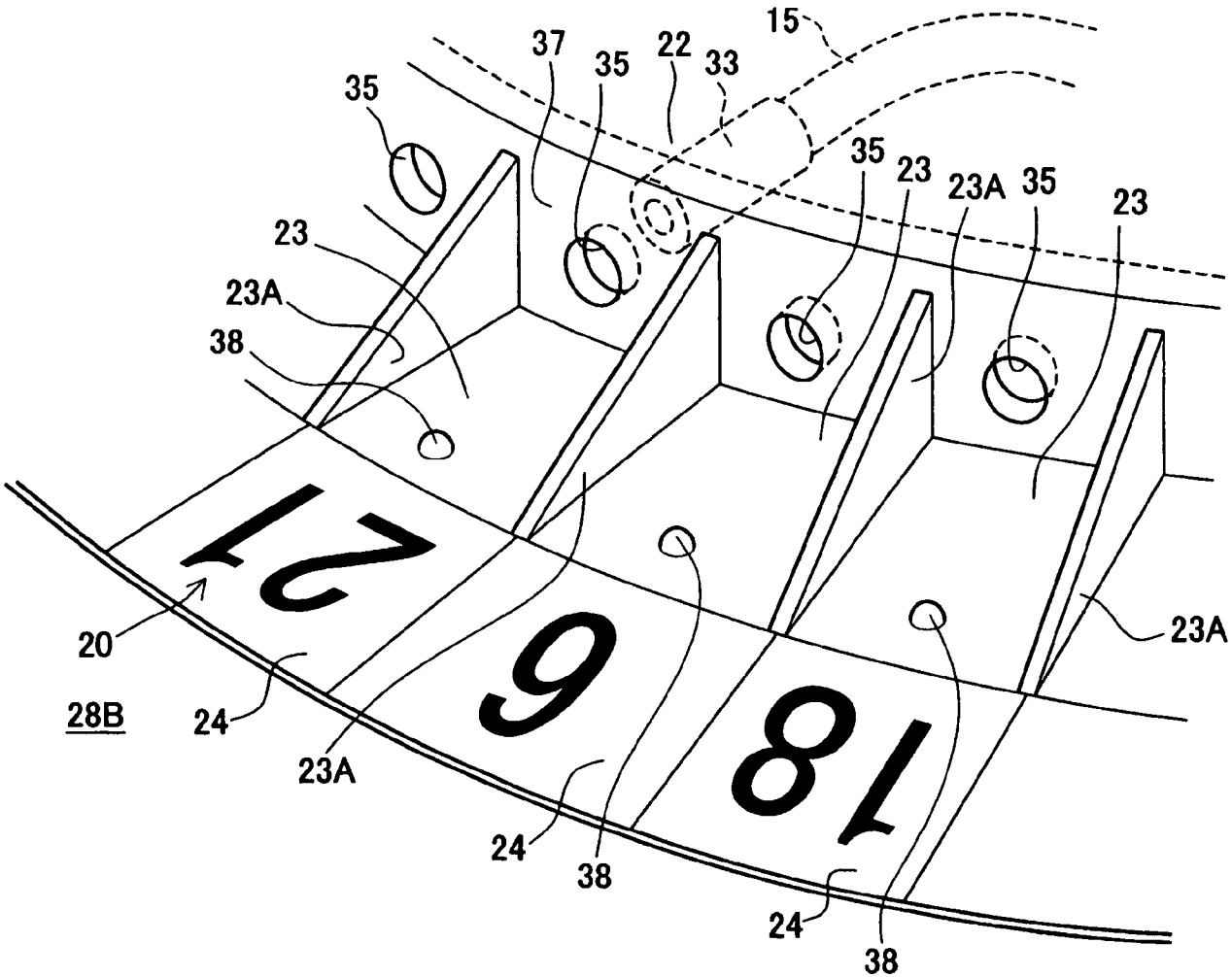
FIG. 6 is an enlarged perspective view of the ball receiving parts in the roulette device according to the exemplary embodiment of the present invention.

Each ball receiving part 23 has an inner wall 37 on which a circular air pass hole 35 is formed (see FIG. 6). In the present exemplary embodiment, since the rotatable portion 20 has thirty-eight ball receiving parts 23, thirty-eight air pass holes 35 are formed. Before the ball 11 is launched from the ball receiving part 23 (ball receiving part opposed to the area to which the numeral "21" is arranged in FIG. 6), the ball receiving part 23 is located at the front of the first outlet portion 33 by rotating the rotatable portion 20. Then, the ball 11 is launched by the compressed air discharged through the first outlet portion 33 and the air pass hole 35 and rolls on the whole slope surface 28 toward the bank passage 29.

Next, the configuration of the second outlet portions 36 will be described with reference to FIGS. 3, 4, 7.

Figure 7:
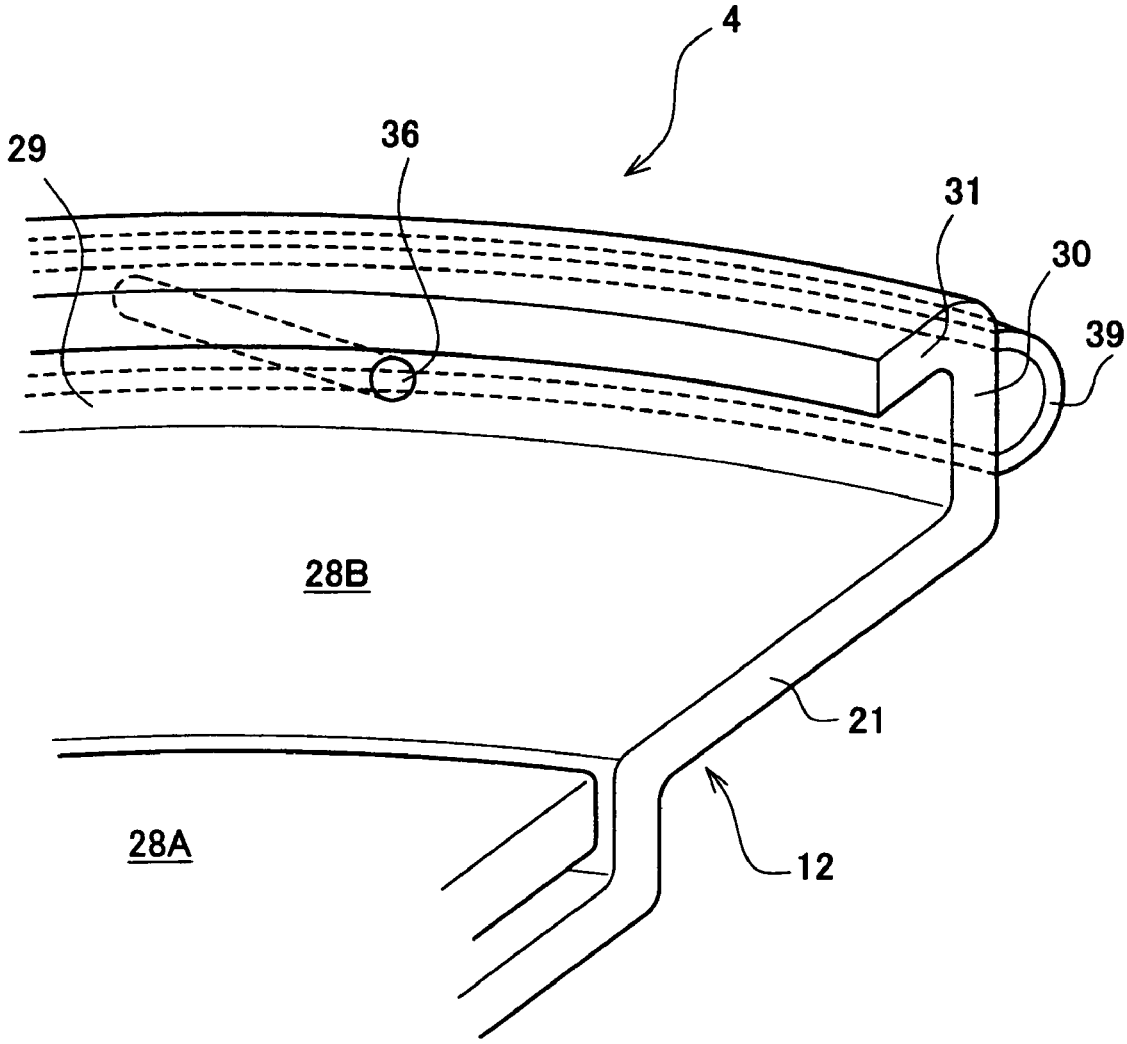
FIG. 7 is an enlarged perspective view of a bank passage in the roulette device according to the exemplary embodiment of the present invention.

As shown in FIGS. 3, 7, the second outlet portions 36 are formed in the guide wall 30 at certain intervals (45° intervals in the present exemplary embodiment). More specifically, each second outlet portion 36 is formed in the guide wall 30 along a tangential direction of the roulette board 12 so as to generate air-flow along a circumferential direction of the bank passage 29 (see FIG. 21).

A semicircular air pipe 39 is installed on a back surface of the guide wall 30. The air pipe 39 is connected to the air tube 16 and the second outlet portions 36. The compressor 14 also generates compressed air and feeds the compressed air into the air pipe 39 through the air tube 16 to discharge the compressed air into the roulette board 12 through the second outlets 36.

When the launched ball 11 reaches the bank passage 29, the ball 11 rolls on the bank passage 29 while accelerating in the circumferential direction of the bank passage 29 by the air discharged from the second outlets 36. In this state, when discharging air from the second outlet portions 36 is stopped, the rolling ball 11 decelerates to lose the centrifugal force acting thereon. Then, the ball 11 rolls down the first slope surface 28B of the rim 21 to reach the rotating rotatable portion 20. Further, the ball 11 rolls on the number indication part 24 of the rotating rotatable portion 20 and then is received into one of the ball receiving parts 23.

Figure 8:
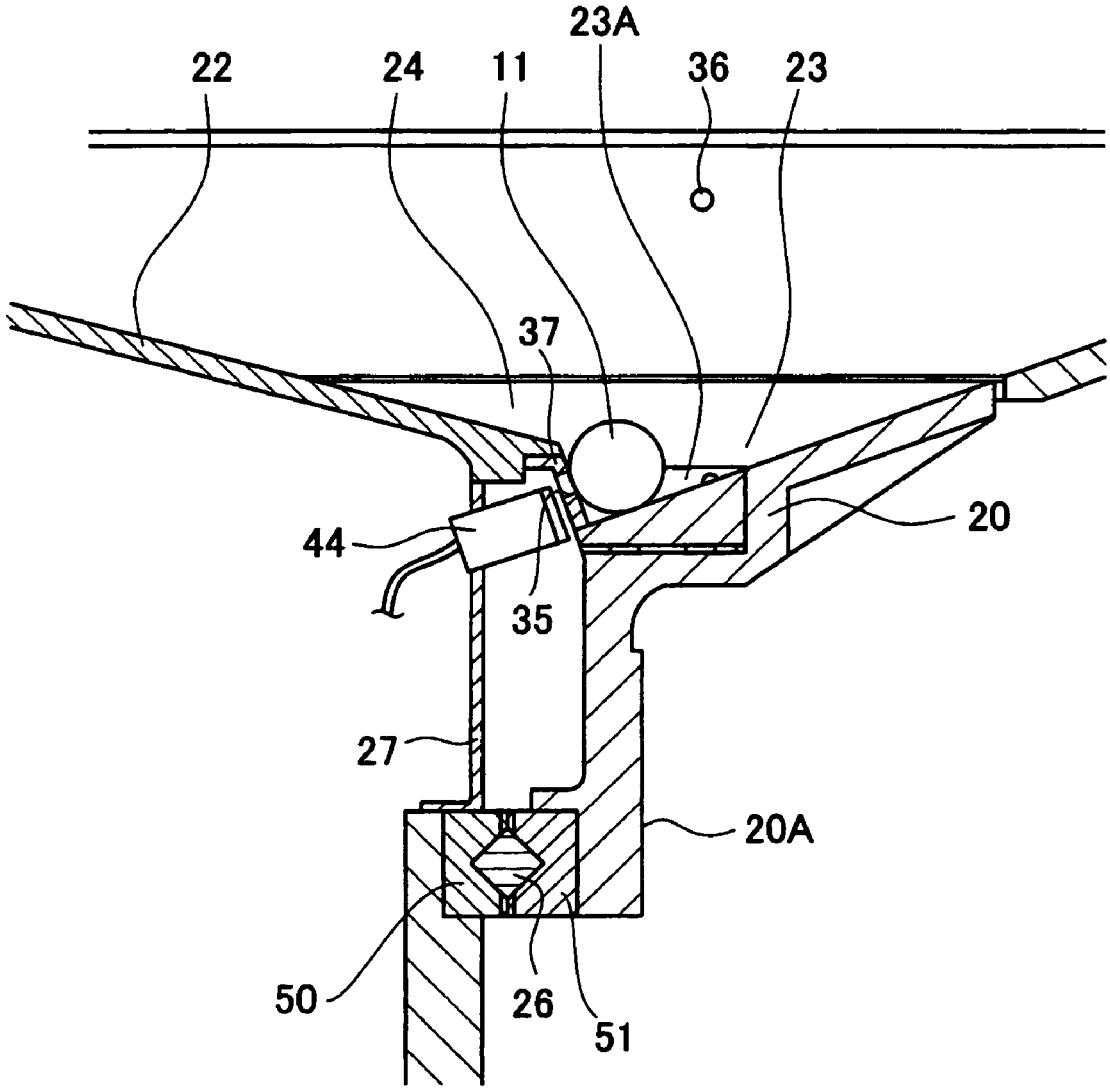
FIG. 8 is a cross-sectional view of the roulette device along the line VIII-VIII shown in FIG. 3.

Next, various sensors employed in the roulette board 12 will be described with reference to FIGS. 3, 8.

The ball detecting sensors 44 are fixedly supported by the clamping plate 27 mounted at the outer periphery edge of the center fixed portion 22 which is opposed to the rotatable portion 20. The ball detecting sensors 44 are arranged at certain intervals (about 120 intervals in the present exemplary embodiment). Each ball detecting sensor 44 is a reflective light sensor and comprises a light emitting element for emitting infrared rays and a light receiving element for receiving the infrared rays reflected by any objects. Therefore, the ball detecting sensor 44 can detect the ball 11 received in the ball receiving part 23 opposed thereto via the air pass hole 35. It is noted that each ball detecting sensor 44 may be a transmissive light sensor and comprise a light emitting element arranged to the bank passage 29 and a light receiving element arranged to the center fixed portion 22 opposed to the light emitting element.

An identification sensor 57 and a rotation sensor 58 are also fixedly supported by the clamping plate 27. The identification sensor 57 detects a specific identification plate (not shown) mounted to the ball receiving part 23 opposed thereto. The rotation sensor 58 detects whether or not the rotatable portion 20 rotates.

A method for identifying one numeral (winning number) arranged to the area opposed to the ball receiving part 23 in which the ball 11 is received will be described.

In the present exemplary embodiment, thirty-eight ball receiving parts 23 surrounds the center fixed portion 22. Each ball receiving part 23 has an identification plate mounted on a back surface of the inner wall 37 thereof. The identification plate has a specific corrugated pattern corresponding to one numeral arranged to the area which is opposed to the ball receiving part 23.

In a condition that the first outlet portion 33, three ball detecting sensors 44, the identification sensor 57 and the rotation sensor 58 are simultaneously opposed to the ball receiving parts 23, these members are arranged to the center fixed plate 22 along an anticlockwise direction of the center fixed plate 22 as follows (see FIG. 3): the ball receiving part 23 opposed to the first ball detecting sensor 44(1st) is arranged at intervals of thirteen ball receiving parts from the ball receiving part 23 opposed to the third ball detecting sensor 44(3rd); the ball receiving part 23 opposed to the second ball detecting sensor 44(2nd) is arranged at intervals of thirteen ball receiving parts from the ball receiving part 23 opposed to the first ball detecting sensor 44(1st); the ball receiving part 23 opposed to the third ball detecting sensor 44(3rd) is arranged at intervals twelve ball receiving parts from the ball receiving part 23 opposed to the second ball detecting sensor 44(2nd); the ball receiving part 23 opposed to the first outlet portion 33 is arranged at intervals of six ball receiving parts from the ball receiving part 23 opposed to the second ball detecting sensor 44(2nd); the ball receiving part 23 opposed to the identification sensor 57 is arranged at intervals of seven ball receiving parts from the ball receiving part 23 opposed to the first ball detecting sensor 44(1st); and the ball receiving part 23 opposed to the rotation sensor 58 is arranged at intervals of five ball receiving parts from the ball receiving part 23 opposed to the first ball detecting sensor 44(1st). The numerals are arranged on the number indication part 24 along an anticlockwise direction of the number identification part 24 as the follows: "0", "2", "14", "35", "23", "4", "16", "33", "21", "6", "18", "31", "19", "8", "12", "29", "25", "10", "27", "00", "1", "13", "36", "24", "3", "15", "34", "22", "5", "17", "32", "20", "7", "11", "30", "26", "9" and "28". The above member arrangements are previously stored in the ROM 81 as a member arrangement table. It is noted that the above member arrangements may be replaced with another member arrangements.

When the ball 11 is received in one of the ball receiving parts 23, one of the ball detecting sensors 44 detects the one ball receiving part 23, and at the same time, the identification sensor 57 detects the identification plate mounted to the ball receiving part 23 opposed thereto while the rotation sensor 58 detects the rotation of the rotatable portion 20. The main control CPU 80 reads the member arrangement table from the ROM 81 and then identifies one numeral (winning number) corresponding to the ball receiving part 23 in which the ball 11 is received with reference to the read member arrangement table (see S20 in FIG. 17) because a positional relation between the identification sensor 57 and the one of the ball detecting sensor 44 has been defined in the member arrangement table.

When next roulette game is started, the identification sensor 57 detects the identification plate mounted to the ball receiving part 23 opposed thereto. Then, the main control CPU 80 identifies the numeral corresponding to the detected identification plate, and determines whether or not the ball receiving part 23 in which the ball 11 is received is located at the front of the first outlet portion 33 on the basis of the previous winning number, the identified numeral and the member arrangement table. If not at the front of the first outlet portion 33, the main control CPU 80 controls the driving motor 34 to locate the ball receiving part 23 in which the ball 11 is received at the front of the first outlet portion 33 in order to launch the ball 11 (see S6 to 8 in FIG. 16).

Next, the rotation driving mechanism and the rotating operation of the rotatable portion 20 will be described with reference to FIGS. 4, 9.

As shown in FIG. 4, the driving motor 34 is fixed on the bottom panel 21A of the rim 21. The driving motor 34 is a stepping motor capable of rotating in a step unit by feeding a pulse signal thereto. The number and durations of the pulse signals fed to the driving motor 34 determine a rotation angle and a rotation speed of the driving motor 34. The driving motor 34 is connected to the main control CPU 80. The main control CPU 80 controls the driving motor 34 according to a program stored in the ROM 81 (see FIGS. 13, 14). When the main control CPU 80 stops feeding the pulse signal to the driving motor 34, the driving motor 34 holds the rotation angle thereof.

The driving motor 34 is connected to the rotatable portion 20 via a driven shaft 46 and a driven roller 47. The driven shaft 46 has one end connected to the driving motor 34 and the other end connected to the driven roller 47. The driven shaft 46 rotates at the same rotation angle and rotation speed as those of the driving motor 34. The driven roller 47 has an outer surface abutting on a side surface 20A of the rotatable portion 20. When the main control CPU 80 drives the driving motor 34, the driving motor 34 rotates the driven roller 47 via the driven shaft 46 to further rotate the rotatable portion 20 with respect to the center fixed portion 22. The driven roller 47 is received in a roller case 48 having a substantial U-letter shape. The roller case 48 is biased toward the side surface 20A of the rotatable portion 20 by a biasing member 49. The biasing member 49 always presses the driven roller 47 on the side surface 20A via the roller case 48 at a proper pressure, which prevents the driven roller 47 from rotating in overload or without abutting on the side surface 20A.

Figure 9:
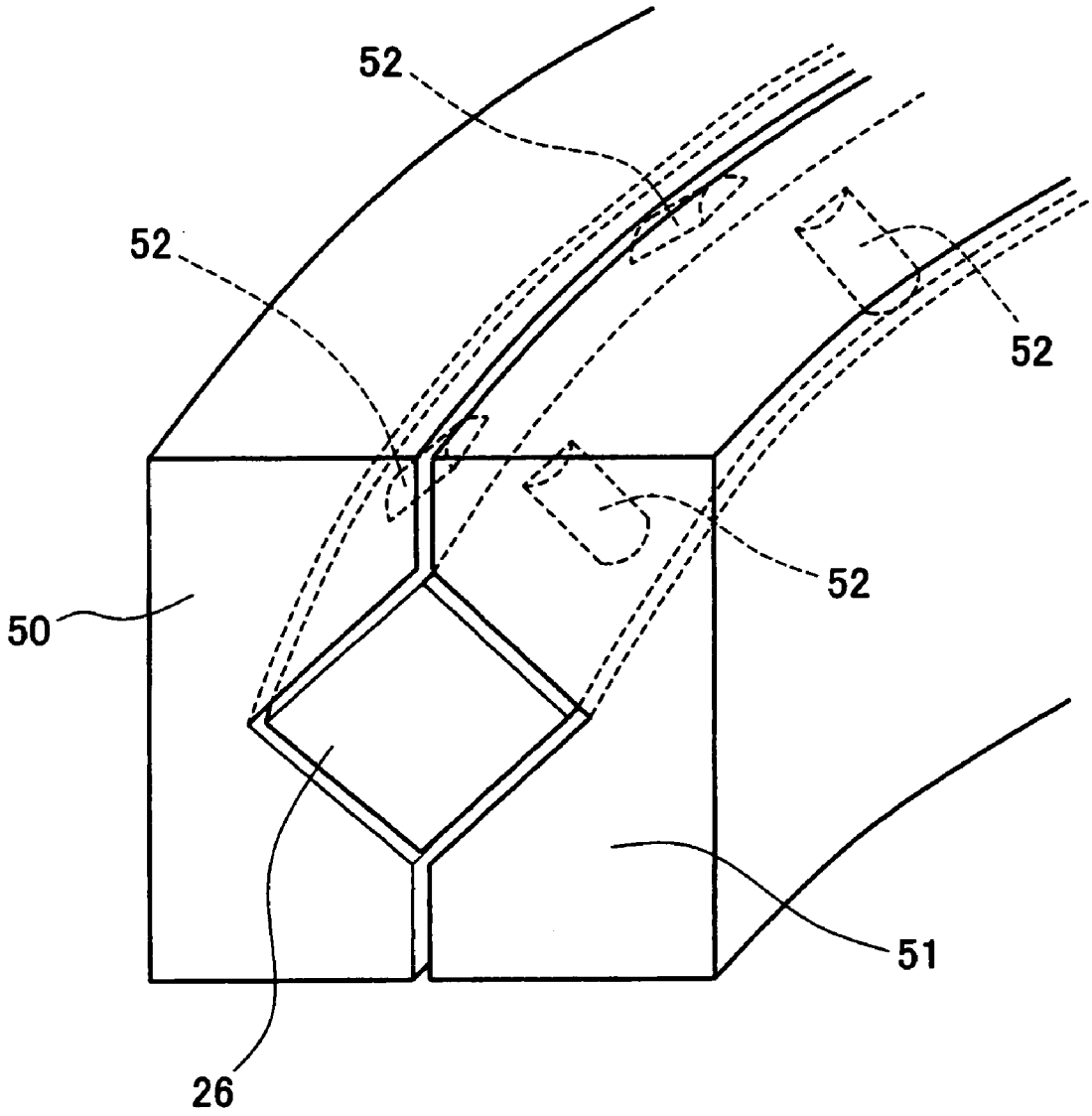
FIG. 9 is an enlarged view of a part of a cross ball bearing according to the exemplary embodiment of the present invention.

As shown in FIGS. 4, 9, an inner extending wall 51 of the rotatable portion 20 is rotatably connected to an outer extending wall 50 of the center fixed portion 22 via the cross ball bearing 26. The cross ball bearing 26 has a substantial ring shape and a substantial square section. The cross ball bearing 26 has a plurality of bearings 52 respectively mounted to somewhere between thirty to forty parts on four side surfaces thereof. The bearings 26 abut the inner extending wall 51 and the outer extending wall 50, so that the rotatable portion 20 is rotatably supported by the center fixed portion 22.

In this configuration, the rotatable portion 20 rotates at a certain speed and by a certain angle with respect to the center fixed portion 22, according to a rotation speed and a rotation angle of the driving motor 34 driven by the pulse signals. This allows the ball detecting sensors 44 to detect the ball receiving part 23 in which the ball 11 is received, and also allows the first outlet portion 33 to launch the ball 11 received in the ball receiving part 23.

Figure 10:
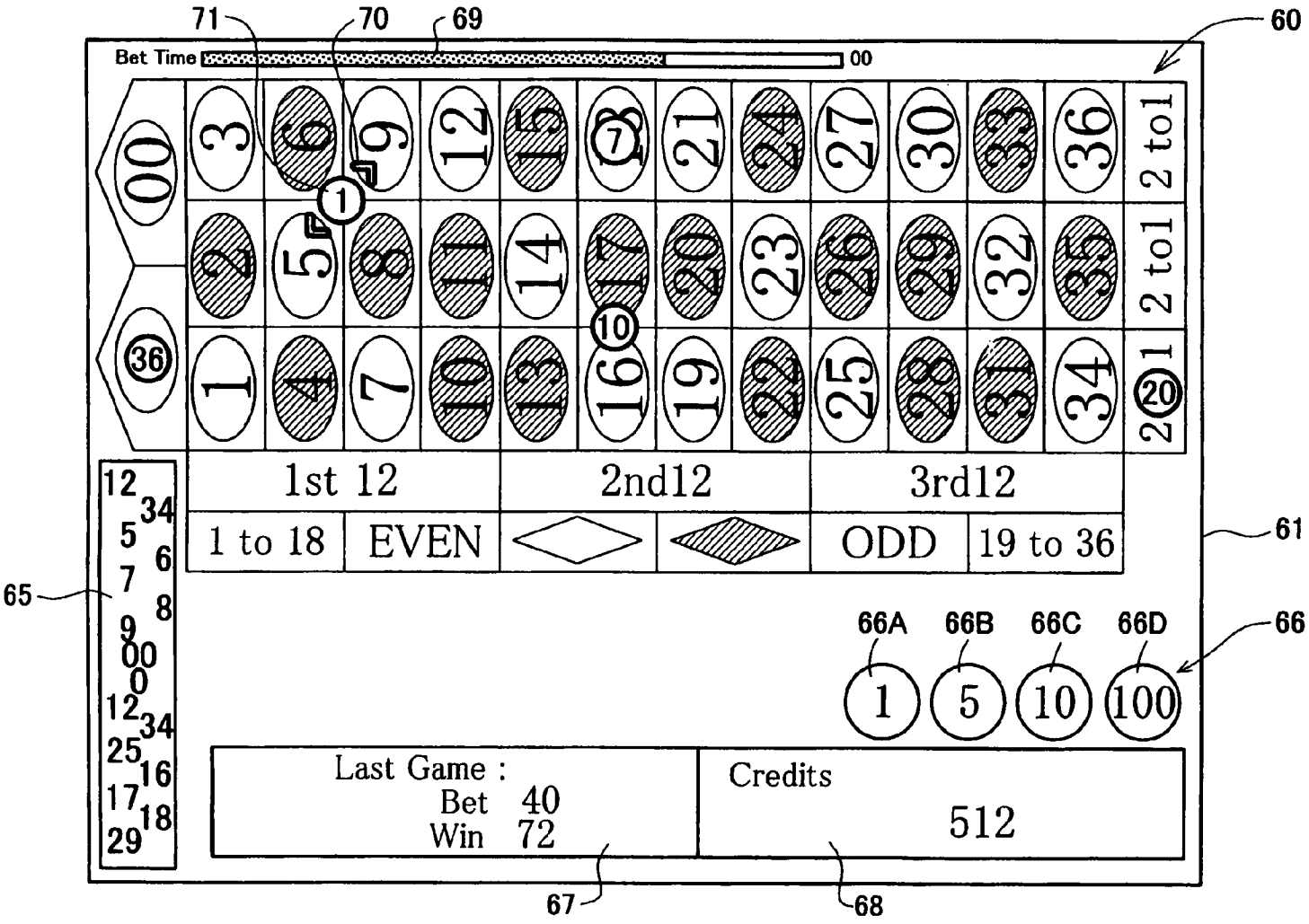
FIG. 10 is a view showing one example of a display screen displayed on an image display device in the roulette gaming machine according to the exemplary embodiment of the present invention.

Next, the configurations of the control portion 6 and the image display device 7 with reference to FIGS. 1, 10.

As shown in FIG. 1, the control portion 6 is arranged on the right side of the image display device 7 and includes buttons to be pressed by a player. More specifically, the control portion 6 has a BET determination button 62, a PAYOUT button 63 and a HELP button 64 in this order from the left side thereof.

When a player determines a bet after carrying out a bet operation in the image display device 7, the player presses the BET determination button 62. Then, if one numeral on which the player has bet becomes a winning number, the number of credits corresponding to the number of bet game media is added to the number of credits which the player possesses at this time. The bet operation will be described later.

When a player finishes playing a roulette game, the player presses the PAYOUT button 63. If the PAYOUT button 63 is pressed, one or more game media corresponding to the number of credits which the player possesses at this time are paid out from the medal payout slot 8. Normally, one game medium corresponds to one credit.

When a player does not know how he/she plays a roulette game, the player presses the HELP button 64. If the HELP button 64 is pressed, the image display device 7 displays a help screen including various types of operation information thereon.

Figure 12:
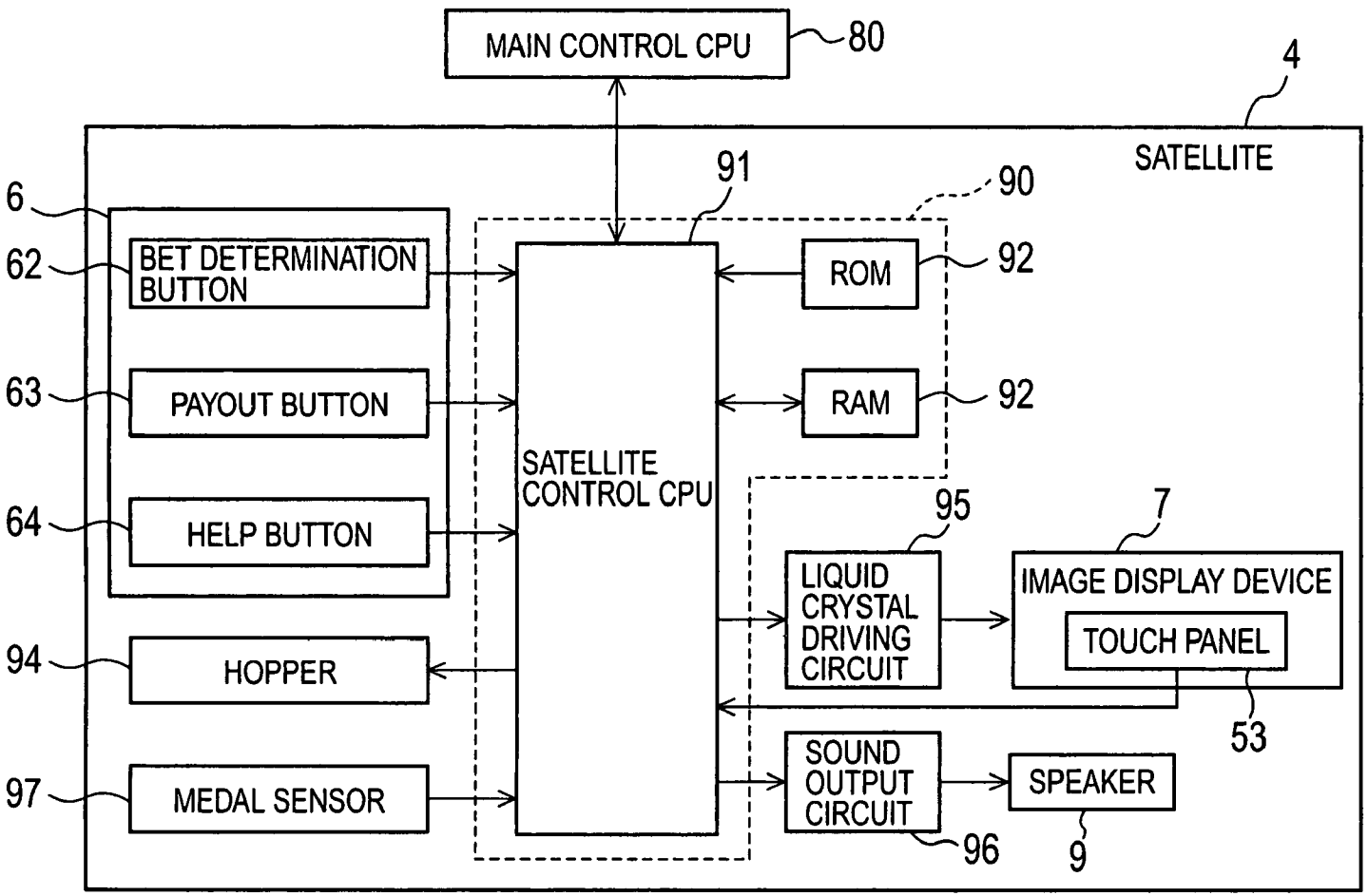
FIG. 12 is a block diagram showing a control system of a satellite in the roulette gaming machine according to the exemplary embodiment of the present invention.

The image display device 7 is a liquid crystal display with a touch panel 53 mounted on a front surface of the liquid crystal display (see FIG. 12). When a player presses via the touch panel 53 an icon displayed on the liquid crystal display with his/her finger, the icon is selected.

As shown in FIG. 10, the image display device 7 displays a BET screen 61 thereon during a roulette game. A player can bet one or more virtual betting chips on one or more desired numerals by means of own one or more credits when operating the BET screen 61. The BET screen 61 includes a table type betting board 60, a result history display part 65, unit BET buttons 66, a payout result display part 67, a credit number display part 68 and a BET timer graph 69 therein.

On the table type betting board 60, numerals "0", "00" and "1" to "36" are arranged in a grid. Also, graphic characters indicating "EVEN", "ODD", "black", "red", "1 to 18", "19 to 36", "1ST 12", "2nd 12", "3rd 12" and "2 to 1" are arranged on the table type betting board 60 in a grid.

Below the table type betting board 60, the result history display part 65, the unit BET buttons 66, the payout result display part 67 and the credit number display part 68 are arranged on the BET screen 61. Above the table type betting board 60, the BET timer graph 69 is arranged on the BET screen 61.

On the result history display part 65, a list of up to sixteen winning numbers is displayed. More specifically, when one roulette game finishes, one winning number selected in the one roulette game is added from the top of the list and the oldest winning number is deleted from the bottom of the list. It is noted that one roulette game means a sequence of events from betting on one or more desired numerals in the satellite 4 to paying out one or more credits according to one winning number selected in this roulette game.

When a player bets on one or more desired numerals, the player operates the unit BET buttons 66. The unit BET buttons 66 includes a 1 BET button 66A, a 5 BET button 66B, a 10 BET button 66C and a 100 BET button 66D. First, a player directly presses with his/her finger a BET area of the table type betting board 60 including a numeral on which the player desires to bet, via the touch panel 53. This causes a cursor 70 to move on the BET area. Then, when the player presses the 1 BET button 66A, the virtual betting chip is bet by one chip (the number of bets increases in an order of "1"→"2"→"3" . . . each time the 1 BET button 66A is pressed with a finger). When the player presses the 5 BET button 66B, the virtual betting chips are bet by five chips (the number of bets increases in an order of "5"→"10"→"15" . . . each time the 5 BET button 66B is pressed with a finger). When the player presses the 10 BET button 66C, the virtual betting chips are bet by ten chips (the number of bets increases in an order of "10"→"20"→"30" . . . each time the 10 BET button 66C is pressed with a finger). When the player presses the 100 BET button 66D, the virtual betting chips are bet by one hundred chips (the number of bets increases in an order of "100"→"200"→"300" . . . each time the 100 BET button 66D is pressed with a finger). Accordingly, a player can bet a large amount of vertical betting chips with simplified operation.

On the payout result display part 67, the number of virtual betting chips bet by a player and the number of credits paid out in a previous roulette game are displayed. At this time, the number of paid out credits minus the number of bet credits is equal to the number of credits which the player has newly obtained in the previous roulette game.

On the credit number display part 68, the number of credits which a player currently possesses is displayed. The number of credits decreases according to the number of virtual betting chips when a player bets the virtual betting chips. The number of credits increases according to the number of paid out credits when a numeral on which a player has bet becomes a winning number. If the number of credits is equal to 0, the roulette game finishes.

The BET timer graph 69 is a graph that shows a remaining time before the roulette gaming machine 1 closes acceptance of the player's bet. In the BET timer graph 69, a red bar gradually extends toward the right end of the BET timer graph 69 when one roulette game starts. If the red bar reaches the right end of the BET timer graph 69, the roulette gaming machine 1 closes the acceptance of the player's bet. At five seconds before the red bar reaches the right end of the BET timer graph 69, the ball 11 received in the ball receiving part 23 is launched by means of the first outlet portion 33.

On the cursor 70 placed on the BET area where a player has selected, a chip mark 71 is displayed to indicate the BET area and the number of virtual betting chips. A numeral displayed on the chip mark 71 indicates the number of virtual betting chips bet by the player. For example, as shown in FIG. 10, the chip mark 71 of "7" placed on the BET area "18" indicates that the player has bet seven virtual betting chips on one numeral "18". A method of betting on only one numeral is called a straight up betting method. The chip mark 71 of "1" placed on an intersecting point of the BET areas "5", "6", "8" and "9" indicates that the player has bet one virtual betting chip on four numerals "5", "6", "8" and "9" simultaneously. A method of betting on the four numerals is called a corner betting method.

Examples of other betting method include the following methods: a split betting method of betting on two numerals by placing the chip mark 71 on a line between the two numerals; a street betting method of betting on three numerals (e.g. "13", "14" and "15") by placing the chip mark 71 on a vertical line of FIG. 10; a five betting method of betting on five numerals "0", "00", "1", "2" and "3" by placing the chip mark 71 on a vertical line between "00" and "3"; a line betting method of betting on six numerals (e.g. "13", "14", "15", "16", "17" and "18") by placing the chip mark 71 on a vertical line of FIG. 10; a column betting method of betting on twelve numerals by placing the chip mark 71 on the graphic character "2 to 1" corresponding to the twelve numerals; a dozen betting method of betting on twelve numerals by placing the chip mark 71 on the graphic character "1st 12", "2nd 12" or "3rd 12" corresponding to the twelve numerals; and another betting method of betting on eighteen numerals according to a color (red or black) of the number indication part 24, odd or even numbers, or "1 to 18" or "19 to 36" by placing the chip mark 71 on each of six graphic characters arranged on the bottom of the table type betting board 60.

When a player makes a bet by using the BET screen 61, the player specifies a desired BET area on the BET screen 61 and then presses it with his/her finger directly. The cursor 70 thereby moves on the desired BET area. Then, the player operates the unit BET buttons 66, the virtual betting chips corresponding to the respective units are bet on the desired BET area. For example, when the player presses the 10 BET button 66C four times, the 5 BET button 66B one time and the 1 BET button 66A three times, forty-eight virtual betting chips can be bet.

Next, a control system of the roulette gaming machine 1 will be described with reference to FIG. 11.

Figure 11:
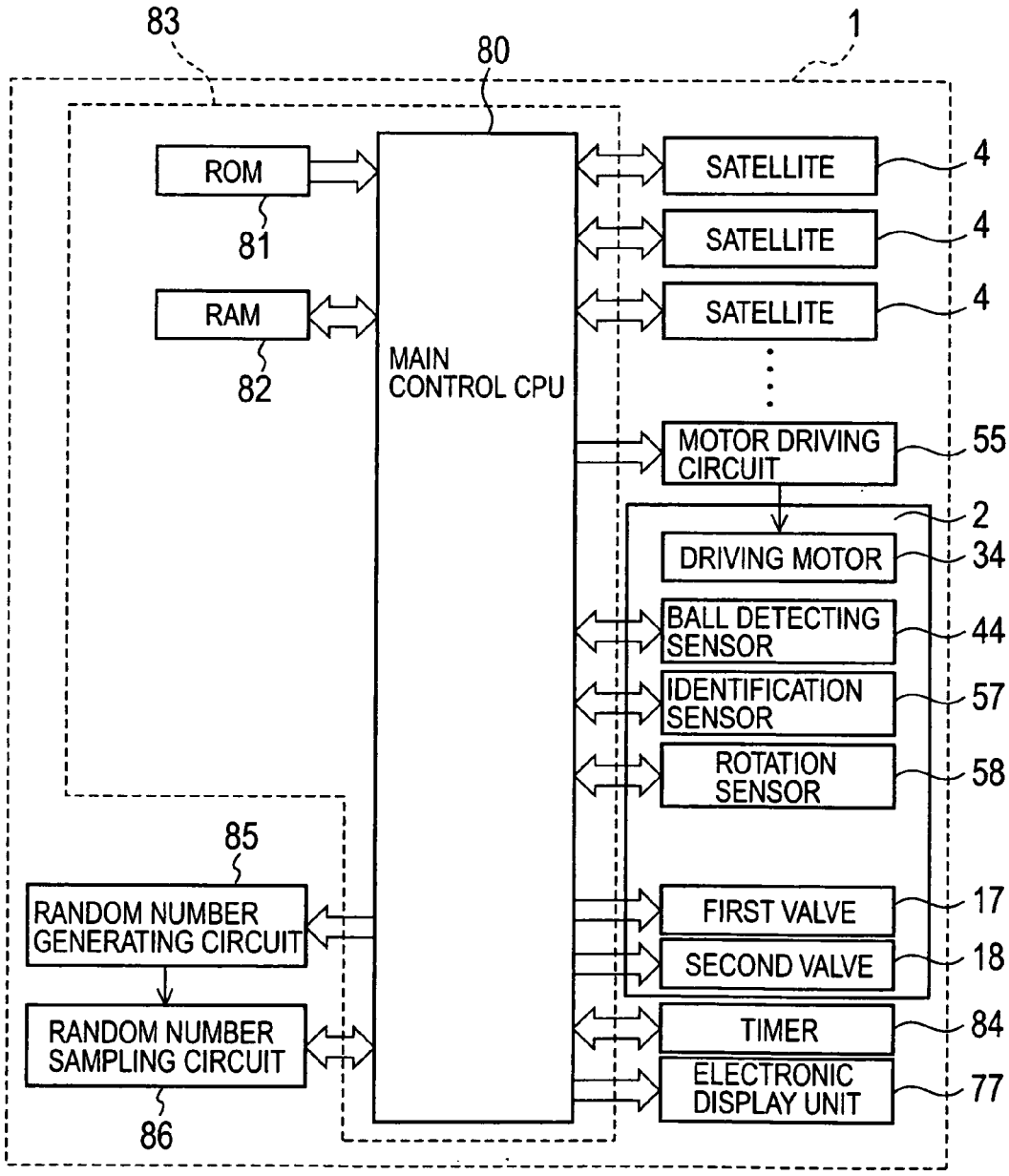
FIG. 11 is a block diagram showing a control system of the roulette gaming machine according to the exemplary embodiment of the present invention.

As shown in FIG. 11, the control system of the roulette gaming machine 1 comprises the roulette device 2, the plurality of satellites 4, a motor driving circuit 55, the electronic display unit 77, a main controller 83, a timer 84, a random number generating circuit 85 and a random number sampling circuit 86.

The main controller 83 comprises the main control CPU 80, the ROM 81 and a RAM 82. The roulette device 2, the satellites 4, the motor driving circuit 55, the electronic display unit 77, the ROM 81, the RAM 82, the timer 84, the random number generating circuit 85 and the random number sampling circuit 86 are connected to the main control CPU 80. The main control CPU 80 executes various processes according to various input signals from the respective satellites 4 and the data and program stored in the ROM 81 or the RAM 82. The main control CPU 80 transmits order signals to the respective satellites 4 according to the result of processes. When the satellite 4 receives the order signal, a roulette game proceeds in the satellites 4.

The roulette device 2 comprises the first valve 17, the second valve 18, the driving motor 34, the ball detecting sensor 44, the identification sensor 57 and the rotation sensor 58. The first valve 17, the second valve 18, the ball detecting sensor 44, the identification sensor 57 and the rotation sensor 58 are connected to the main control CPU 80. Also, the driving motor 34 is connected to the main control CPU 80 via the motor driving circuit 55.

The main control CPU 80 transmits various order signals to the roulette device 2 according to the result of processes. When the roulette device 2 receives a motor driving order signal, the driving motor 34 is driven to launch the ball 11 and then cause the launched ball 11 to roll. More specifically, when the main control CPU 80 outputs the motor driving order signal into the motor driving circuit 55, the motor driving circuit 55 generates pulse signals to output them into the driving motor 34. If the driving motor 34 receives the pulse signals, the driving motor 34 is driven to rotate at a certain rotation speed, in a certain rotation direction and during a certain period, according to the received pulse signals. Thereby, the rotatable portion 20 rotates with respect to the rim 21 and the center fixed portion 22, at the certain rotation speed, in the certain rotation direction and during the certain period, according to a control program for the driving motor 34 stored in the ROM 81.

When the roulette device 2 receives sensor action order signals, the ball detecting sensors 44, the identification sensor 57 and the rotation sensor 58 are controlled to obtain various types of associated information and then output them to the main controller 83. Thereby, the main control CPU 80 can identify one numerical (winning number) corresponding to the ball receiving part 23 in which the ball 11 is received. Also, the main control CPU 80 can determine whether or not the ball receiving part 23 in which the ball 11 is received is located at the front of the first outlet portion 33. Further, when the roulette device 2 receives valve action order signals, the first valve 17 and the second valve 18 are opened or closed to adjust air pressure within the air tubes 15, 16. If the first valve 17 is opened, air compressed by the compressor 14 is discharged from the first outlet 33. If the second valve 18 is opened, air compressed by the compressor 14 is discharged from the second outlets 36.

The ROM 81 consists of a semiconductor memory and permanently stores therein the following data and programs: a program for implementing basic functions of the roulette gaming machine 1; a program for controlling elements (e.g. the first valve 17, the second valve 18, the driving motor 34, the ball detecting sensor 44, the identification sensor 57 and the rotation sensor 58) in the roulette device 2; a rotation period lottery table 99 employed when one rotation pattern of the rotatable portion 20 (drive control pattern for the driving motor 34) is selected among a plurality of rotation patterns (see FIG. 15); odds (the number of credits paid out per one virtual betting chip) for a typical roulette game; a program for controlling the respective satellites 4; and the member arrangement table.

The RAM 82 temporarily stores therein the following data and programs: bet information about the virtual betting chips supplied from the respective satellites 4; a winning number identified by the main control CPU 80; and various data on results of processes executed by the main control CPU 80.

The random number generating circuit 85 sequentially generates random numbers within a constant range according to an order of the main control CPU 80. The random number sampling circuit 86 samples one random number among the generated random numbers in a certain sampling period and then inputs the sampled random number into the main control CPU 80 according to an order of the main control CPU 80. The sampled random number is employed to select one rotation pattern of the rotatable portion 20 among the plurality of rotation patterns, with reference to the rotation period lottery table 99.

The electronic display unit 77 controls emission of an emission means such as a light emitting diode (LED) to produce electrical spectaculars or cause the jackpot value display 78 to display the jackpot value. The timer 84 outputs time information into the main control CPU 80. The main control CPU 80 controls the first valve 17, the second valve 18 and the driving motor 34 according to the time information.

Next, a control system of the satellite 4 will be described with reference to FIG. 12.

As shown in FIG. 12, the control system of the satellite 4 comprises the control portion 6, the image display device 7, the speaker 9, a satellite controller 90, the hopper 94, a liquid crystal driving circuit 95, a sound output circuit 96 and the medal sensor 97. The satellite controller 90 comprises a satellite control CPU 91, a ROM 92 and a RAM 93. The control portion 6, the image display device 7, the ROM 92, the RAM 93, the hopper 94, the liquid crystal driving circuit 95, the medal sensor 97 are connected to the satellite control CPU 91. Also, the speaker 9 is connected to the satellite control CPU 91 via the sound output circuit 96.

The ROM 92 consists of a semiconductor memory and permanently stores therein the following data and programs: a program for implementing basic functions of the satellite 4; and a program and table for controlling elements in the satellite 4. The RAM 93 temporarily stores therein the following data and programs: various data on results of processes executed by the satellite control CPU 91; the number of credits which a player currently possesses; and bet information about the virtual betting chips bet by a player.

In the control portion 6, the BET determination button 62, the PAYOUT button 63 and the HELP button 64 are connected to the satellite control CPU 91. When the BET determination button 62 is pressed, the satellite control CPU 91 receives a determination signal from the control portion 6 to execute various processes according to the programs and data stored in the ROM 92 and/or the RAM 93. Then, the satellite control CPU 91 outputs data on results of the processes into the main control CPU 80. When the PAYOUT button 63 is pressed, the satellite control CPU 91 receives a payout order signal from the control portion 6 and controls the hopper 94 to pay out from the medal payout slot 8 one or more game media corresponding to the number of credits which a player currently possesses. When the HELP button 64 is pressed, the satellite control CPU 91 receives a help order signal from the control portion 6 and control the image display device 7 by means of the liquid crystal driving circuit 95 to display the help screen on the image display device 7. Further, when a winning number is determined, the satellite control CPU 91 receives an update order signal from the main control CPU 80 and control the image display device 7 by means of the liquid crystal driving circuit 95 to update contents displayed on the BET screen 61.

The liquid crystal driving circuit 95 comprises a program ROM, an image ROM, an image control CPU, a work RAM, a video display processor (VDP) and a video RAM. The program ROM stores therein an image control program and various selection tables regarding a display of the image display device 7. The image ROM stores therein dot data employed to form an image to be displayed on the image display device 7. The image control CPU determines an image to be displayed on the image display device 7 on the basis of the dot data, according to a parameter set in the satellite control CPU 91 and the image control program. The work RAM is temporarily employed when the image control CPU executes the image control program. The VDP is employed to form an image according to display contents determined by the image control CPU and then output it into the image display device 7. The video RAM is temporarily employed when the VDP forms the image.

The touch panel 53 is mounted on the front surface of the liquid crystal display in the image display device 7. When a player has carried out an operation of the touch panel 53 such as a selection of the BET area and an operation of the unit BET buttons 66, bet information about virtual betting chips bet by the player is supplied to the satellite control CPU 91. If the satellite control CPU 91 receives the bet information, the satellite control CPU 91 stores the bet information (e.g. one or more BET areas specified by the player and the number of the virtual betting chips) on the RAM 93. Further, the satellite control CPU 91 supplies the bet information to the main control CPU 80 and then stores it on a bet information memory area in the RAM 82.

The satellite 4 outputs effective sounds via the speakers 9 according to an output signal from the sound output circuit 96. The medal sensor 97 detects the number of game media inserted from the medal insertion slot 5 and outputs it into the satellite control CPU 91. The satellite control CPU 91 increases the number of credits stored in the RAM 93 according to the number of inserted game media.

Next, an open-and-close timing of the first valve 17 and the second valve 18 and a drive timing of the driving motor 34 will be described with reference to FIG. 13.

Figure 13:
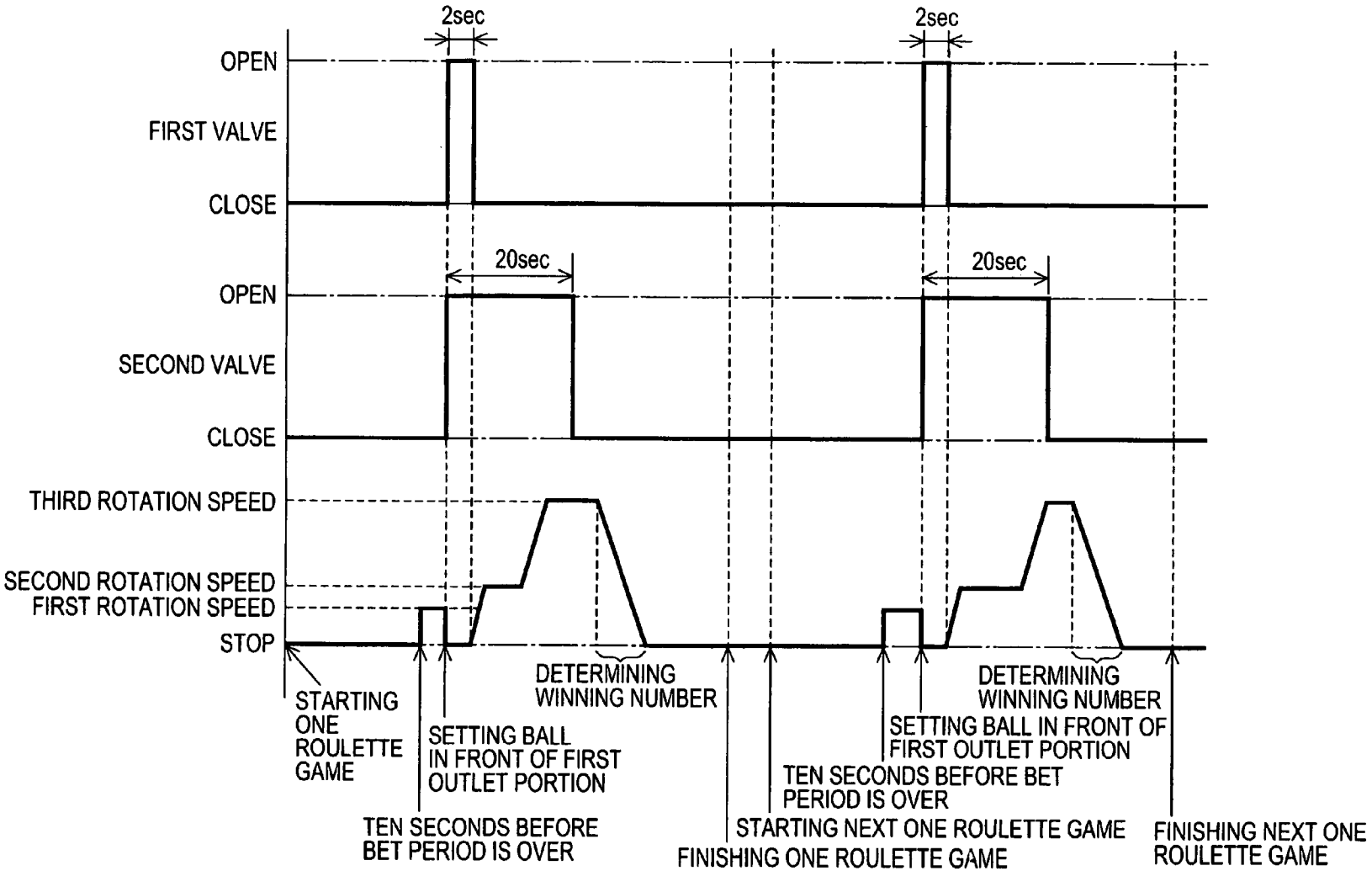
FIG. 13 is a timing diagram of a first valve, a second valve and a driving motor according to the exemplary embodiment of the present invention.

As shown in FIG. 13, when one roulette game starts, the one roulette game proceeds with a bet period for receiving the player's bet in the satellite 4. At ten seconds before the bet period is over, if the main control CPU 80 determines that the ball receiving part 23 receiving the ball 11 therein is not located at the front of the first outlet portion 33 according to a previous winning number and a detection result of the identification sensor 57, the main control CPU 80 drives the driving motor 34 at a first rotation speed and in a certain rotation direction, to rotate the rotatable portion 20 with respect to the center fixed portion 22 at a certain rotation speed (e.g. 4 rpm) until the ball receiving part 23 is located at the front of the first outlet portion 33. Then, at five seconds before the bet period is over, the main control CPU 80 simultaneously opens the first valve 17 during a certain period (2 seconds in the present exemplary embodiment) and the second valve 18 during a certain period (20 seconds in the present exemplary embodiment). Thereby, the ball 11 is launched from the ball receiving part 23 toward the bank passage 29 and then rolls on the bank passage 29 in a clockwise direction of the bank passage 29.

When the certain period regarding the first valve 17 is over, the main control CPU 80 drives the driving motor 34 to rotate the rotatable portion 20 with respect to the center fixed portion 22, during a first step period. The rotation speeds of the driving motor 34 and the rotatable portion 20 linearly increase until they reach a second rotation speed and a certain rotation speed (e.g. 5.005 rpm). Then, when the first step period is over, the main control CPU 80 drives the driving motor 34 to rotate the rotatable portion 20 with respect to the center fixed portion 22, during a second step period. The rotation speeds of the driving motor 34 and the rotatable portion 20 linearly increase until they reach a third rotation speed and a certain rotation speed (e.g. 16.683 rpm). Here, it is noted that parts of the first and second step periods are varied every one roulette game, according to one random number sampled among the generated random numbers (see FIG. 14).

When the certain period regarding the second valve 18 is over, the main control CPU 80 closes the second valve 18 to stop discharging the compressed air from the second outlet portions 36. Thereby, the ball 11 gradually decelerates because air-flow disappears from the bank passage 29. The ball 11 rolls down the first slope surface 28B of the rim 21 in time to reach the rotating rotatable portion 20. When the ball 11 enters the rotating rotatable portion 20, the ball 11 rolls on the number indication part 24 and then is received into one of the ball receiving parts 23. At a few seconds after the second valve 18 is closed, the main control CPU 80 linearly decreases the rotation speed of the driving motor 34 to slow the rotation speed of the rotatable portion 20. While the rotatable portion 20 slowly rotates, the main control CPU 80 drives the ball detecting sensor 44, the identification sensor 57 and the rotation sensor 58 to determine a winning number on the basis of data from these sensors and the member arrangement table stored in the ROM 81. Then, the main control CPU 80 transmits the update order signal to the satellite control CPU 91 and the one roulette game finishes. If next one roulette game continuously starts, the above processes are carried out again.

Next, a rotation form of the rotatable portion 20 and a drive control of the driving motor 34 between the time when the ball 11 is launched and the time when the ball 11 rolls down will be described, with reference to FIG. 14.

Figure 14:
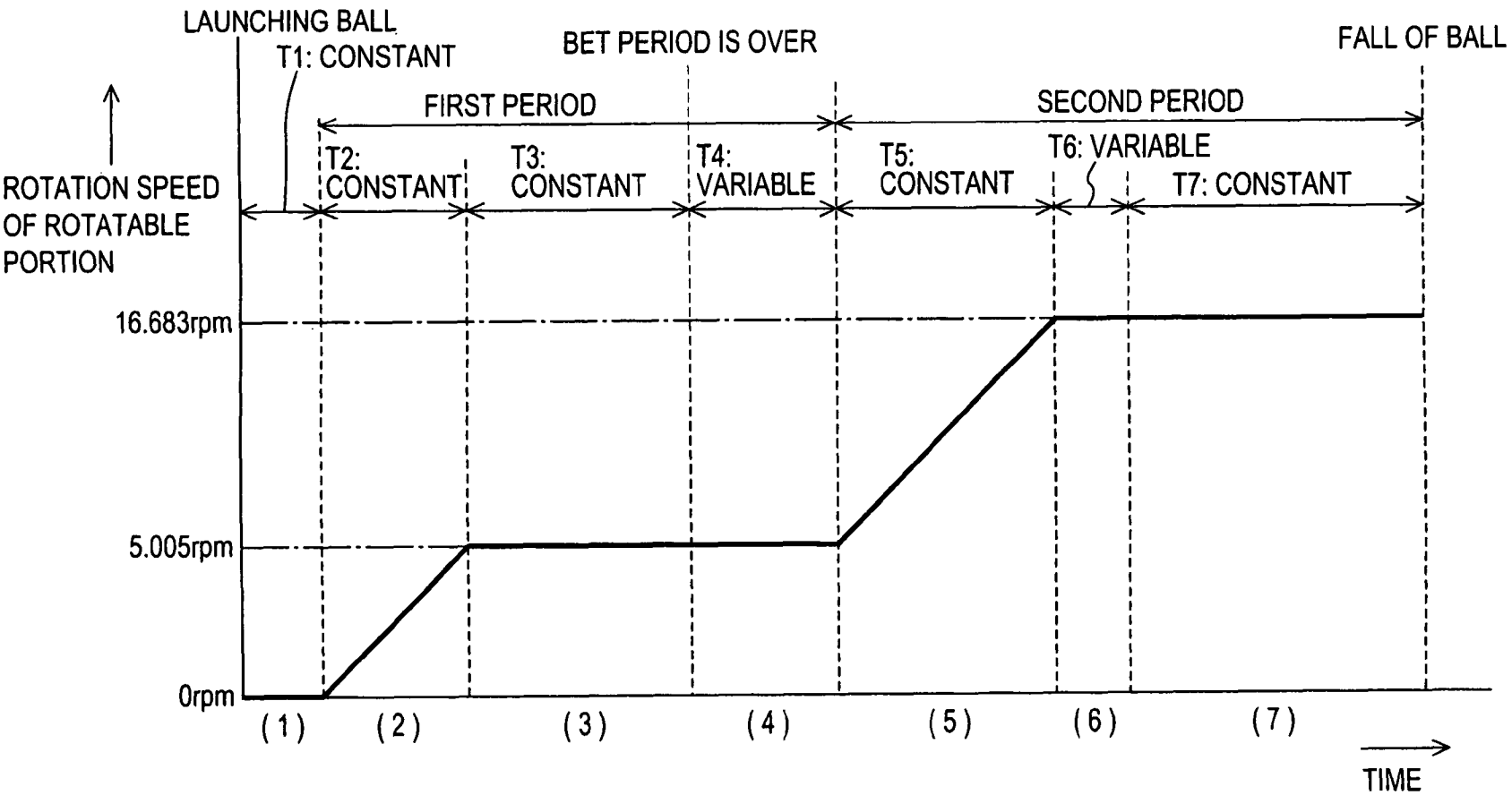
FIG. 14 is a timing diagram of a rotatable portion between a time when a ball is launched and a time when a ball rolls down according to the exemplary embodiment of the present invention.

As shown in FIG. 14, a rotation term of the rotatable portion 20 between the time when the ball 11 is launched and the time when the ball 11 rolls down consists of seven periods.

In a first period T1 between the time when the ball 11 is launched and the time when the rotatable portion 20 starts to rotate, the main control CPU 80 continues to stop driving the driving motor 34 so that the rotation speed of the rotatable portion 20 is equal to 0 rpm.

In a second period T2 between the time when the rotatable portion 20 starts to rotate and the time when the rotation speed of the rotatable portion 20 reaches 5.005 rpm, the main control CPU 80 drives the driving motor 34 so that the rotation speed of the rotatable portion 20 linearly increases from 0 rpm to 5.005 rpm.

In a third period T3 between the time when the rotation speed of the rotatable portion 20 is equal to 5.005 rpm and the time when the main control CPU 80 closes the acceptance of the player's bet, the main control CPU 80 drives the driving motor 34 so that the rotatable portion 20 maintains the rotation speed at 5.005 rpm.

In a fourth period T4 between the time when the main control CPU 80 closes the acceptance of the player's bet and the time when the rotation speed of the rotatable portion 20 starts to increase again, the main control CPU 80 drives the driving motor 34 so that the rotatable portion 20 maintains the rotation speed at 5.005 rpm.

In a fifth period T5 between the time when the rotation speed of the rotatable portion 20 starts to increase again and the time when it reaches 16.683 rpm, the main control CPU 80 drives the driving motor 34 so that the rotation speed of the rotatable portion 20 linearly increases from 5.005 rpm to 16.683 rpm.

In a sixth period T6 between the time when the rotation speed of the rotatable portion 20 is equal to 16.683 rpm and the time when the main control CPU 80 closes the second valve 18, the main control CPU 80 drives the driving motor 34 so that the rotatable portion 20 maintains the rotation speed at 16.683 rpm.

In a seventh period T7 between the time when the main control CPU 80 closes the second valve 18 and the time when the ball 11 will roll down, the main control CPU 80 drives the driving motor 34 so that the rotatable portion 20 maintains the rotation speed at 16.683 rpm.

The first step period consists of the second to fourth periods T2, T3, T4. The second step period consists of the fifth to seventh periods T5, T6, T7. Time lengths of the first to third, fifth and sixth periods T1, T2, T3, T5, T7 are fixed. On the other hand, time lengths of the fourth and sixth periods T4, T6 are varied every one roulette game, according to one random number sampled among the generated random numbers, the rotation period lottery table 99, the member arrangement table, and a positional relation between one numeral assigned to the ball receiving part 23 opposed to the first outlet portion 33 and one numeral (previous winning number) assigned to the ball receiving part 23 in which the ball 11 is received.

Next, a process for determining time lengths of the fourth and sixth periods T4, T6 will be described with reference to FIG. 15.

As shown in FIG. 15, combinations of time lengths of the fourth and sixth periods T4, T6 are previously set to thirty-eight patterns in the rotation period lottery table 99. The main control CPU 80 selects one pattern among the thirty-eight patterns on the basis of one random number sampled among the random numbers sequentially generated within the range of "0" to "37" by the random number sampling circuit 86. For example, if the sampled one random number is equal to "32", the main control CPU 80 selects one combination of the time length "0.776 sec" of the fourth period T4 and the time length "4.500 sec" of the sixth period T6. If the sampled one random number is equal to "7", the main control CPU 80 selects one combination of the time length "4.156 sec" of the fourth period T4 and the time length "1.120 sec" of the sixth period T6.

In the rotation period lottery table 99, although the total time length of the fourth and sixth periods T4, T6 is fixed to "5.276 sec", a rotation number per 5.276 sec of the rotatable portion 20 increases from "n" to "n+⅓s" (0<n) in proportion as the random number increases from "m" to "m+1" (0≦m≦36). More specifically, the rotatable portion 20 rotates by extra one ball receiving part 23 in proportion as the random number increases from "m" to "m+1".

The main control CPU 80 compensates the sampled random number, on the basis of the positional relation between one numeral assigned to the ball receiving part 23 opposed to the first outlet portion 33 and one numeral (previous winning number) assigned to the ball receiving part 23 in which the ball 11 is received. More specifically, the main control CPU 80 first identifies one numeral assigned to the ball receiving part 23 opposed to the identification sensor 57, by means of the identification sensor 57. Next, the main control CPU 80 calculates the positional relation between one numeral assigned to the ball receiving part 23 opposed to the first outlet portion 33 and the previous winning number, with reference to the identified one numeral and the member arrangement table. It is noted that a position a relation between the identification sensor 57 and the first outlet portion 33 has been defined in the member arrangement table. When the main control CPU 80 identifies the previous winning number as 1-th numeral (0≦1≦38) from one numeral assigned to the ball receiving part 23 opposed to the first outlet portion 33 in an anticlockwise direction of the number identification part 24, the main control CPU 80 adds "1" to the sampled random number and then identifies the added random number as a compensation random number. If the added random number is more than "37", the main control CPU 80 subtracts "38" from the added random number and then identifies the subtracted random number as a compensation random number. Then, the main control CPU 80 sets values corresponding to the compensation random number in the rotation period lottery table 99 to time lengths of the fourth and sixth periods T4, T6 (see FIG. 18). Therefore, the rotatable portion 20 rotates by extra "1" ball receiving part(s) 23 in an anticlockwise direction thereof during the fourth and sixth periods T4, T6.

In the roulette gaming machine 1, when the ball 11 is launched, the ball receiving part 23 in which the ball 11 is received is located at the front of the first outlet portion 33. The main control CPU 80 however carries out the above-described compensation according to the positional relation between one numeral assigned to the ball receiving part 23 opposed to the first outlet portion 33 and one numeral (previous winning number) assigned to the ball receiving part 23 in which the ball 11 is received. Therefore, in a case where the random number generating circuit 85 is a pseudo random number generating circuit, even if skilled players obtain the previous winning number, the tendency for random numbers to be generated by the random number generating circuit 85, and the fourth and sixth periods T4, T6 corresponding to each random number in each roulette game, they can not roughly predict a next winning number because they need to additionally know the arrangement of the rotatable portion 20 at the time of stopping the rotation of the rotatable portion 20 after the ball 11 is received in one of the ball receiving parts 23 in the previous roulette game.

As a result of the compensation, the arrangement of the rotatable portion 20 at the time of stopping the rotation of the rotatable portion 20 depends on randomness in the current roulette game and chaos in the previous roulette game. It is noted that the randomness is caused when the random number generating circuit 85 sequentially generates random numbers and the chaos is caused when the ball 11 rolls on the roulette board 12. The tendency for random numbers is therefore disturbed by the chaos caused in the previous roulette game. On the other hand, in the conventional roulette gaming machine, since the compensation is not carried out, the arrangement of the rotatable portion at the time stopping the rotation of the rotatable portion depends on only randomness caused when the random number generating circuit sequentially generates random numbers in the current roulette game. The tendency for random numbers therefore remains.

Figure 16:
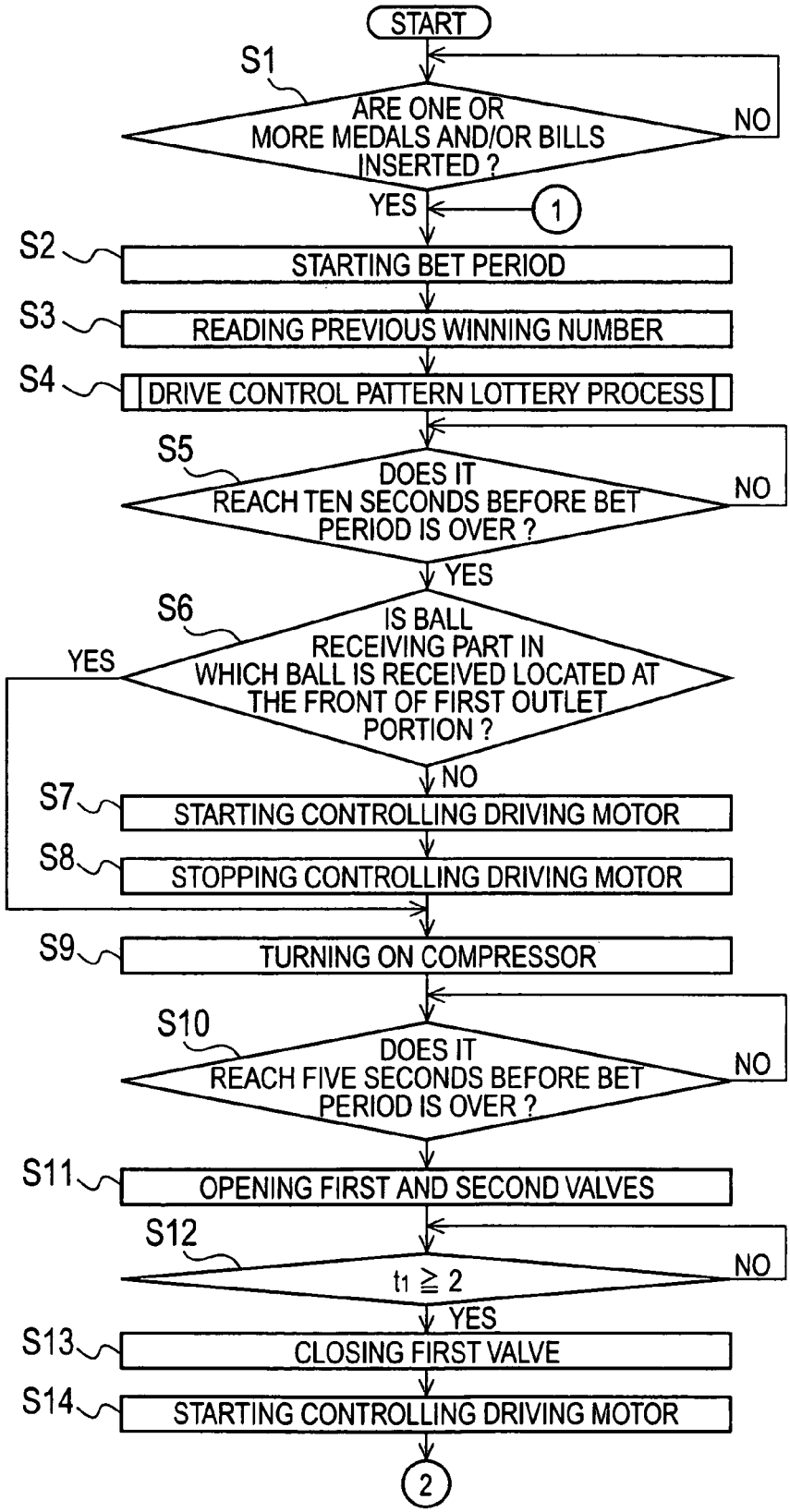
FIG. 16 is a first half of a flow chart of a typical roulette game process program according to the exemplary embodiment of the present invention.
Figure 17:
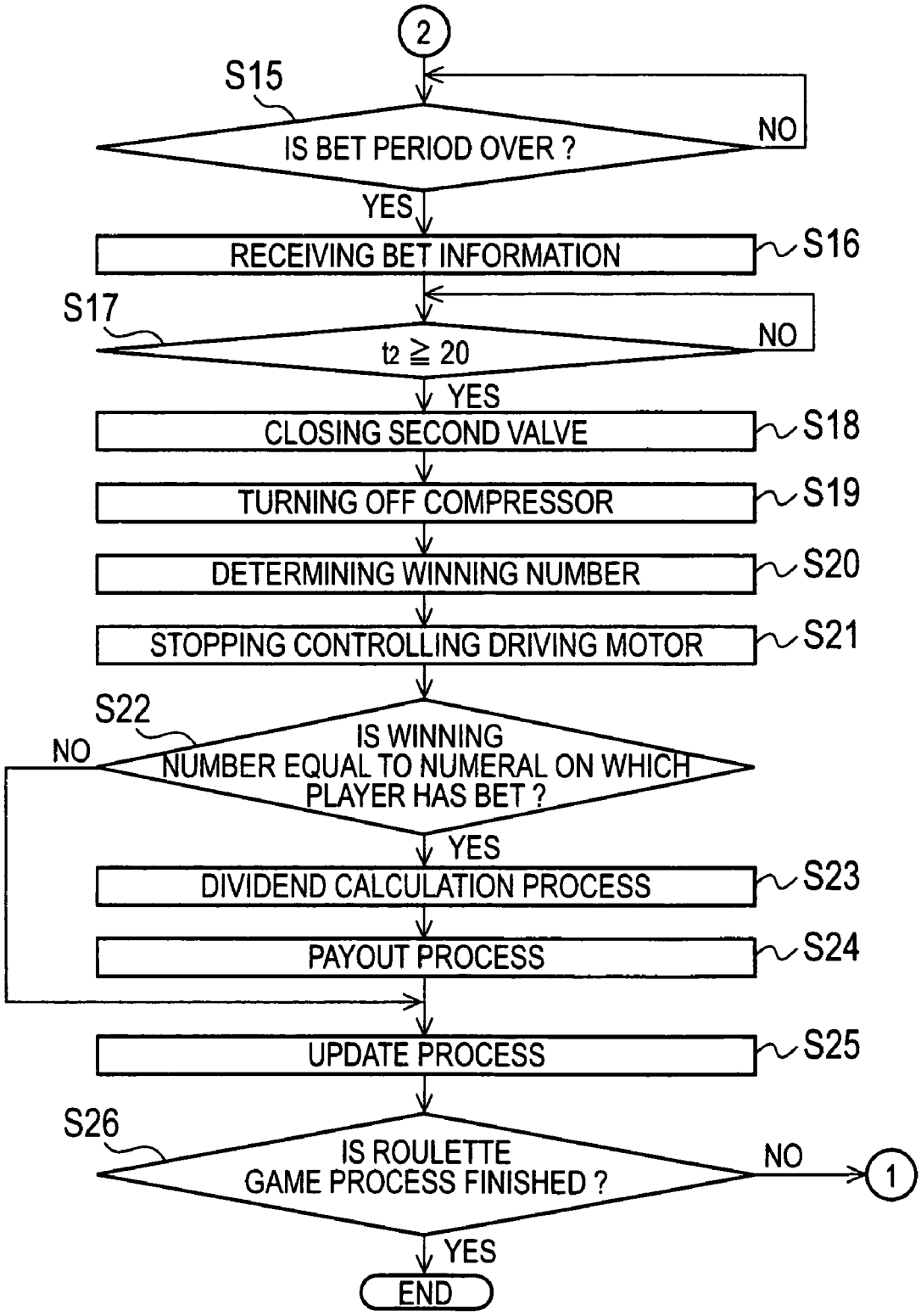
FIG. 17 is a second half of the flow chart of the typical roulette game process program according to the exemplary embodiment of the present invention.

Next, a roulette game process program executed by the roulette gaming machine 1 will be described with reference to FIGS. 16, 17.

In step S1, the main control CPU 80 determines whether or not a player has inserted one or more medals and/or bills. When the player inserts one or more medals and/or bills into the medal insertion slot 5 in each satellite 4, the medal sensor 97 detects the inserted medals and/or bills and then sends a detecting signal to the satellite control CPU 91. The satellite control CPU 91 of the satellite 4 transmits a medal detecting signal to the main control CPU 80 of the roulette gaming machine 1. Also, the satellite control CPU 91 stores in the RAM 93 the number of credits corresponding to the inserted one or more medals and/or bills. When the main control CPU 80 receives the medal detecting signal, the main control CPU 80 determines that the player has inserted one or more medals and/or bills. If the player has inserted one or more medals and/or bills, the process proceeds in step S2. If the player has not inserted one or more medals and/or bills, the process remains in step S1.

In step S2, a bet period when the main control CPU 80 receives a player's bet starts. When the bet period starts, the satellite control CPU 91 causes the image display device 7 to display the BET screen 61 thereon (see FIG. 10). The bet period is shown by the BET timer graph 69. When the bet period starts, the satellite control CPU 91 also causes the red bar in the BET timer graph 69 to gradually extend toward the right side of the BET timer graph 69. If the red bar reaches the right side of the BET timer graph 69, the bet period is over. During the bet period, the player can operate the touch panel 53 to bet one or more virtual betting chips on one or more desired numerals. It is noted that other players (up to twelve players in the present exemplary embodiment) can participate this roulette game during the bet period.

In step S3, if there is a winning number in a previous roulette game on a winning number memory area of the RAM 82, the main control CPU 80 reads the winning number from the RAM 82. In step S4, the main control CPU 80 carries out a drive control pattern lottery process for selecting one driving control pattern for the driving motor 34 by means of a random number sampled by the random number sampling circuit 86 and the rotation period lottery table 99 (see FIG. 18).

In step S5, the main control CPU 80 determines whether or not it reaches ten seconds before the bet period is over. If it reaches ten seconds before the bet period is over, the process proceeds to step S6. If it does not reach ten seconds before the bet period is over, the process remains in step S5. In step S6, the main control CPU 80 determines whether or not the ball receiving part 23 receiving the ball 11 therein is located at the front of the first outlet portion 33 according to the previous winning number and a detection result of the identification sensor 57. If the ball receiving part 23 receiving the ball 11 therein is located at the front of the first outlet portion 33, the process proceeds to step S9. If the ball receiving part 23 receiving the ball 11 therein is not located at the front of the first outlet portion 33, the process proceeds to step S7.

In step S7, the main control CPU 80 drives the driving motor 34 at the first rotation speed and in a certain rotation direction, to rotate the rotatable portion 20 with respect to the center fixed portion 22 at a certain rotation speed (e.g. 4 rpm) until the ball receiving part 23 receiving the ball 11 therein is located at the front of the first outlet portion 33. In step S8, when the ball receiving part 23 receiving the ball 11 therein is located at the front of the first outlet portion 33, the main control CPU 80 stops driving the driving motor 34.

Figure 19:
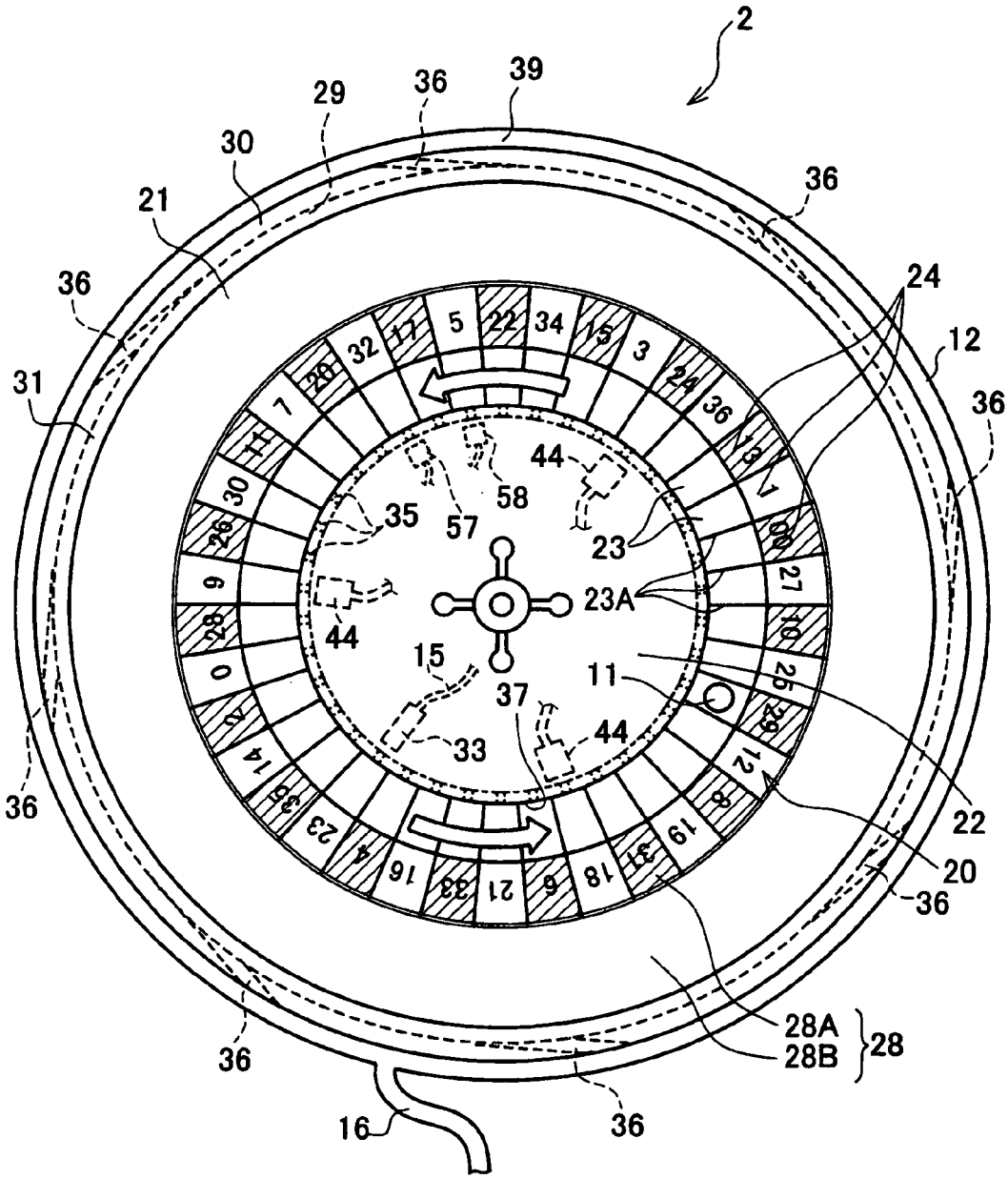
FIG. 19 is a view showing a ball trajectory in the roulette device during the period of steps S6 to S8 shown in FIG. 16.
Figure 20:
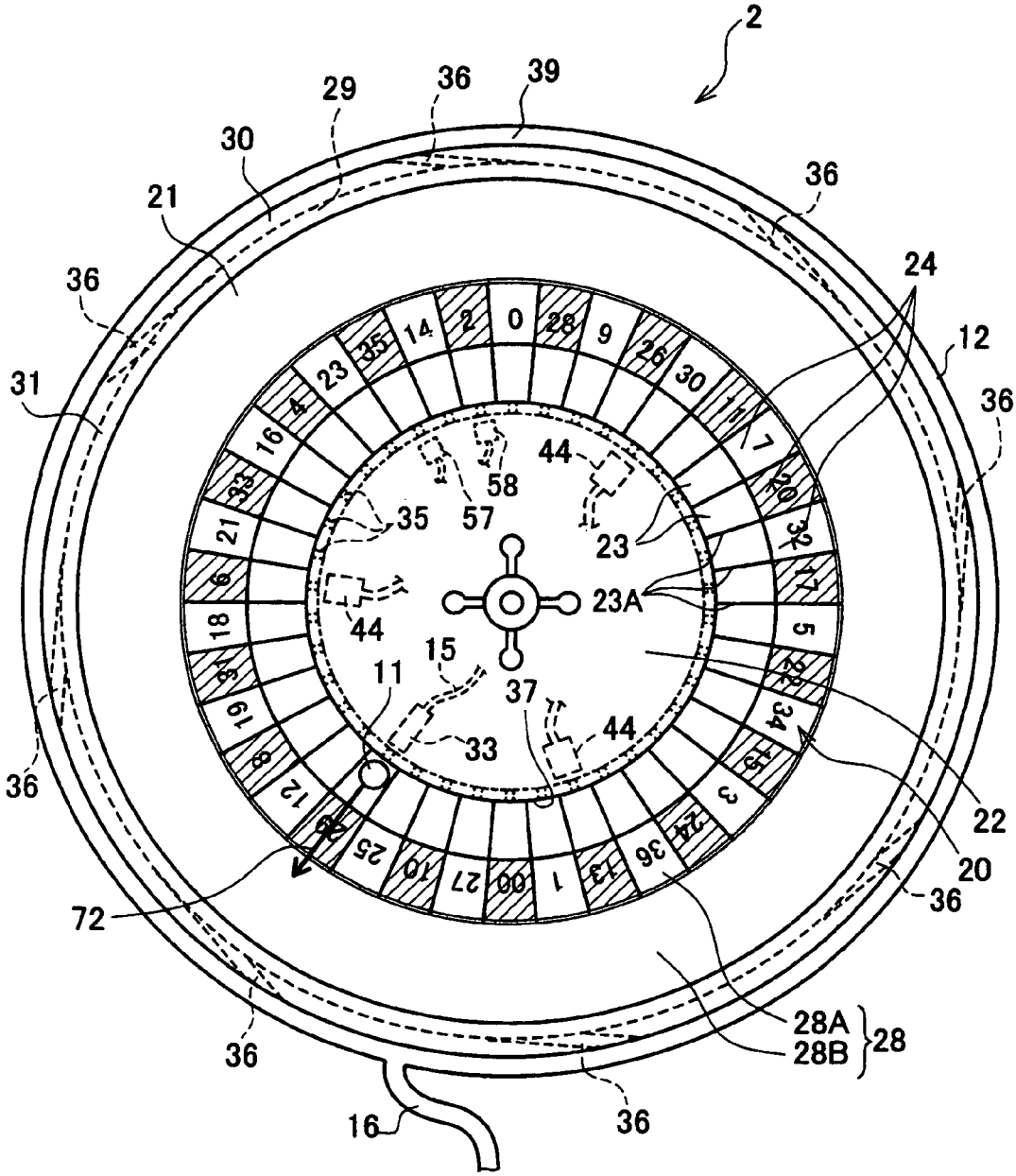
FIG. 20 is a view showing a ball trajectory in the roulette device in step S11 shown in FIG. 16.

For example, as shown in FIG. 19, it assumes that the ball receiving part 23 (opposed to the area of the number indication part 24 to which the numeral "29" is arranged) receiving the ball 11 therein is the twenty-seventh ball receiving part 23 with respect to the ball receiving part 23 opposed to the first outlet portion 33, in the clockwise direction of the number indication part 24. In this case, the main control CPU 80 drives the driving motor 34 to rotate the rotatable portion 20 in the anticlockwise direction and at the certain rotation angle corresponding to twenty-seven ball receiving parts 23.

In step S9, the main control CPU 80 turns on the compressor 14 to cause the compressor 14 to compress the surrounding air. In step S10, the main control CPU 80 determines whether or not it reaches five seconds before the bet period is over. If it reaches five seconds before the bet period is over, the process proceeds to step S11. If it does not reach five seconds before the bet period is over, the process remains in step S10.

In step S11, the main control CPU 80 simultaneously opens the first valve 17 during the certain period t1 (2 seconds in the present exemplary embodiment) and the second valve 18 during the certain period t2 (20 seconds in the present exemplary embodiment). Thereby, the ball 11 is launched from the ball receiving part 23 toward the bank passage 29 in a direction of an arrow 72 shown in FIG. 20 and then rolls on the bank passage 29 in a direction of an arrow 73 shown in FIG. 21. In step S12, the main control CPU 80 determines whether or not the certain period t1 regarding the first valve 17 is over, by using the timer 84. If the certain period t1 is over, the process proceeds to step S13. If the certain period t1 is not over, the process remains in step S12.

In step S13, the main control CPU 80 closes the first valve 17. In step S14, the main control CPU 80 drives the driving motor 34 to rotate the rotatable portion 20 with respect to the center fixed portion 22 during the first and second step periods, according to the one drive control pattern selected in the drive control pattern lottery process in step S4.

Figure 21:
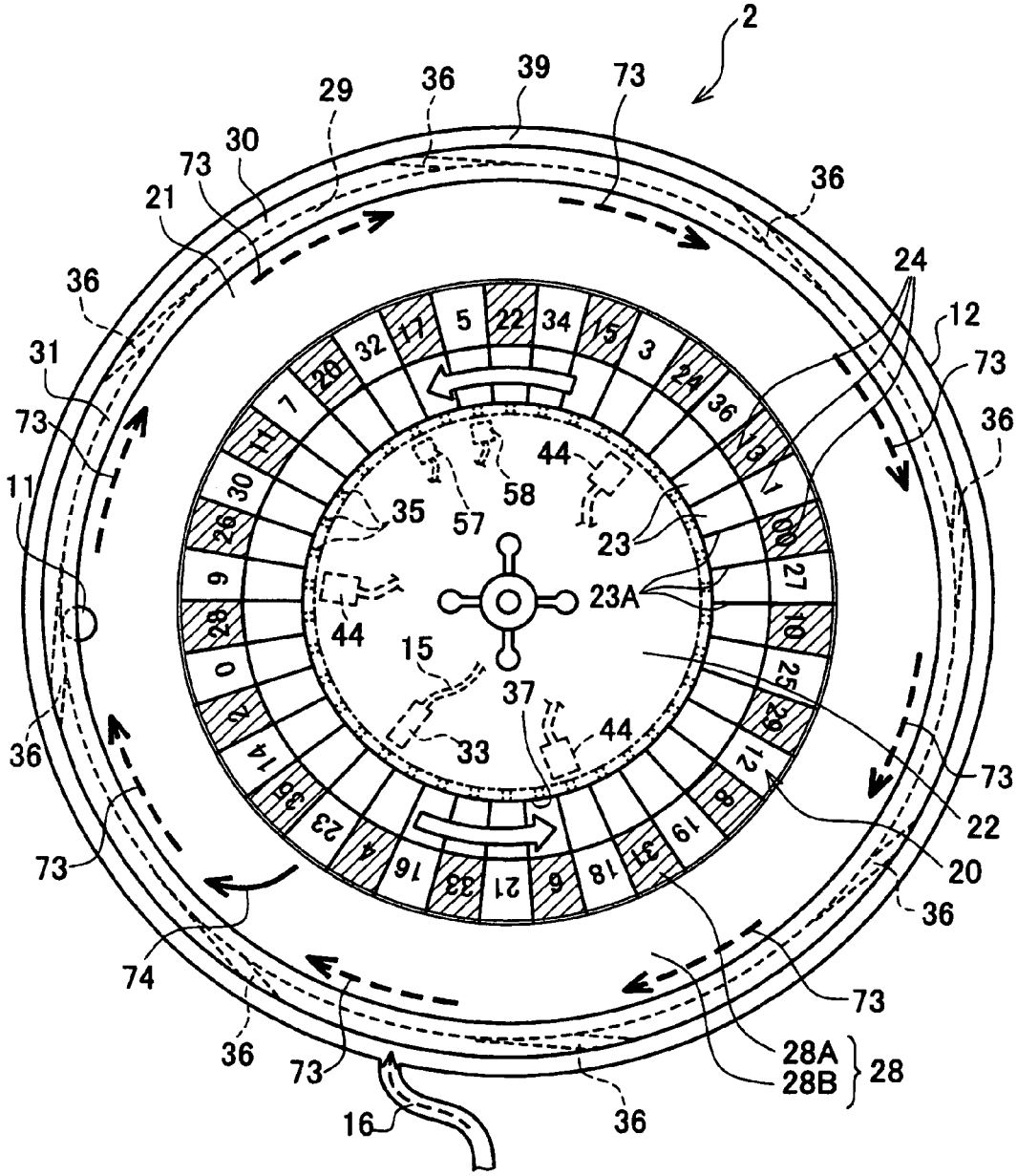
FIG. 21 is a view showing a ball trajectory in the roulette device during the period of steps S14 to S17 shown in FIGS. 16, 17.

As shown in FIG. 21, when the main control CPU 80 opens the second valve 18 in step S11, the second valve 18 generates air-flow in the clockwise direction along the bank passage 29 by the compressed air discharged from the second outlet portions 36. The traveling direction of the launched ball 11 is changed from the radial direction to the circumferential direction of the roulette board 12 by the air-flow, along a direction of an arrow 74.

In step S15, the main control CPU 80 determines whether or not the bet period is over. If the bet period is over, the process proceeds to step S16. If the bet period is not over, the process remains in step S15. In step S16, the main control CPU 80 transmits a betting end signal to the satellite control CPU 91 of each satellite 4 and then receives bet information about virtual betting chips bet by the player from the satellite control CPU 91 of each satellite 4. More specifically, if the satellite control CPU 91 receives the betting end signal, the satellite control CPU 91 causes the image display device 7 to display "BET PERIOD IS OVER" on the BET screen 61 and rejects the operations from the touch panel 53. Then, the satellite control CPU 91 transmits the bet information to the main control CPU 80 and then stores the bet information on the bet information memory area in the RAM 82.

In step S17, the main control CPU 80 determines whether or not the certain period t2 regarding the second valve 18 is over, by using the timer 84. If the certain period t2 is over, the process proceeds to step S18. If the certain period t2 is not over, the process remains in step S17. In step S18, the main control CPU 80 closes the second valve 18. In step S19, the main control CPU 80 turns off the compressor 14 to cause the compressor 14 to stop compressing the surrounding air.

Figure 22:
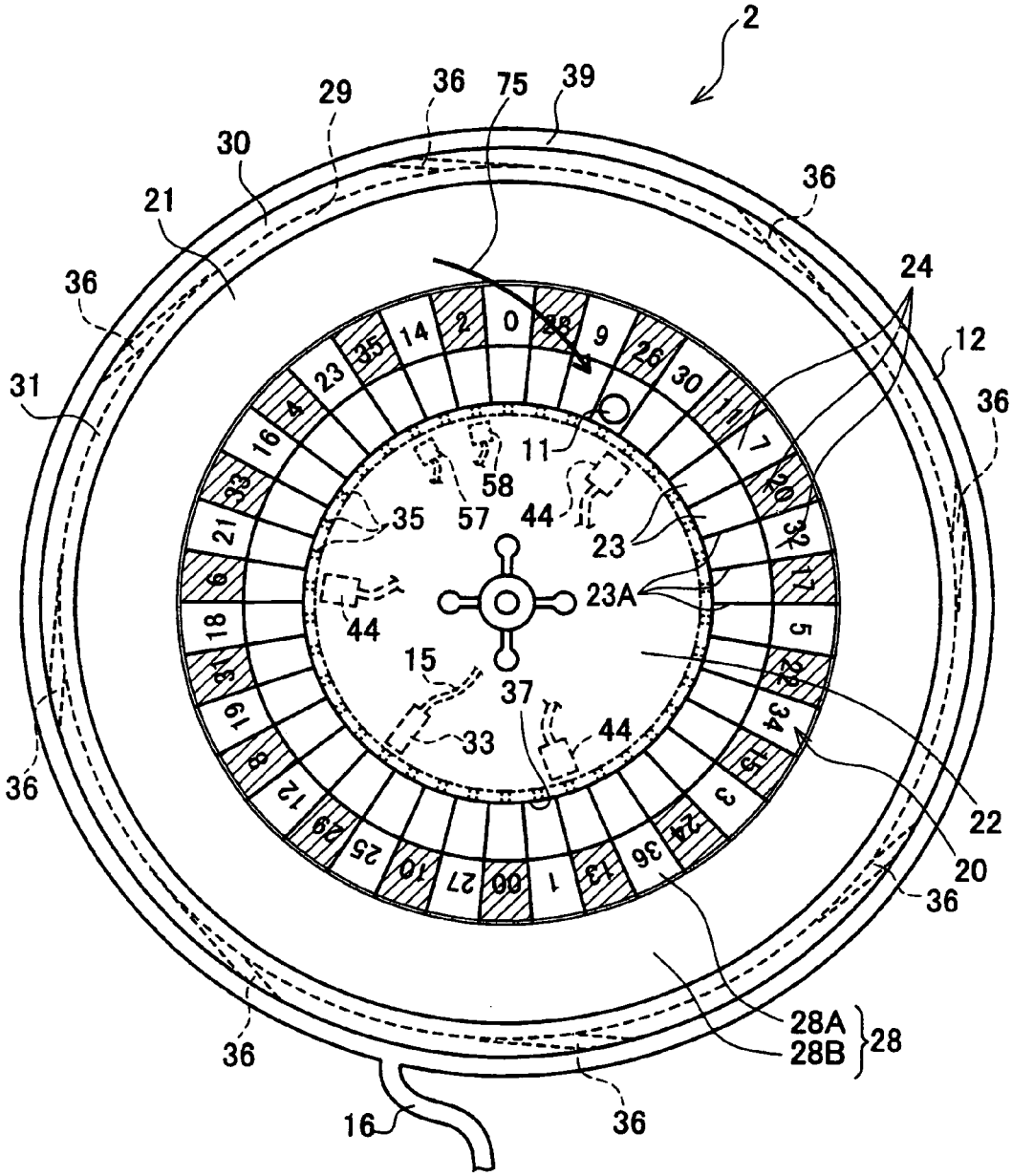
FIG. 22 is a view showing a ball trajectory in the roulette device in step S18 shown in FIG. 17.

As shown in FIG. 22, when the main control CPU 80 closes the second valve 18 in step 18, the air-flow disappears from the bank passage 29. Thereby, the ball 11 gradually decelerates and then rolls down the first slope surface 28B of the rim 21 in time to reach the rotating rotatable portion 20 (see a direction of an arrow 75). When the ball 11 enters the rotating rotatable portion 20, the ball 11 rolls on the number indication part 24 and then is received into one of the ball receiving parts 23.

In step 20, the main control CPU 80 determines a winning number by means of the ball detecting sensor 44, the identification sensor 57 and the rotation sensor 58. More specifically, at a few seconds after the second valve 18 is closed, the main control CPU 80 linearly decreases the rotation speed of the driving motor 34 to slow the rotation speed of the rotatable portion 20. While the rotatable portion 20 slowly rotates, the main control CPU 80 drives the ball detecting sensor 44, the identification sensor 57 and the rotation sensor 58 to determine the winning number on the basis of data from these sensors and the member arrangement table stored in the ROM 81.

In step S21, the main control CPU 80 stops driving the driving motor 34. In step S22, the main control CPU 80 determines whether or not the winning number is equal to one of the one or more desired numerals on which the player has bet in each satellite 4, on the basis of the winning number determined in step S20 and the bet information stored in the RAM 82. If the winning number is equal to one of the one or more desired numerals, the process proceeds to step S23. If the winning number is not equal to one of the one or more desired numerals, the process proceeds to step S25.

In step S23, the main control CPU 80 carries out a dividend calculation process. In the dividend calculation process, the main control CPU 80 recognizes each satellite 4 in which the player has bet on the winning number and then calculates a dividend amount to be paid out for the each satellite 4 by means of odds (the number of credits per one virtual betting chip to be paid out) stored in a dividend credit memory area of the ROM 81, with respect to the BET area, which includes the winning number, specified by the player.

In step S24, the main control CPU 80 transmits credit data corresponding to the calculated dividend amount to the satellite control CPU 91 of the each satellite 4. If the satellite control CPU 91 receives the credit data, the satellite control CPU 91 carries out a payout process. In the payout process, the satellite control CPU 91 adds the number of credits corresponding to the calculated dividend amount to the number of credits, which the player possesses at this time, stored in the RAM 93.

In step S25, the main control CPU 80 carries out an update process. In the update process, the main control CPU 80 transmits an update order signal to the satellite control CPU 91 of each satellite 4. If the satellite control CPU 91 receives the update order signal, the satellite control CPU 91 updates contents displayed on the BET screen 61 and then finish one roulette game.

In step S26, the main control CPU 80 determines whether or not the process finishes. More specifically, the main control CPU 80 determines whether or not all participating one or more satellites 4 transmit process end signals thereto. In each participating satellite 4, if the PAYOUT button 63 is pressed, the satellite control CPU 91 paid out one or more game media corresponding to the number of credits which the player possesses at this time, from the medal payout slot 8 via the hopper 94. Then, the satellite control CPU 91 transmits the process end signal to the main control CPU 80. If the main control CPU 80 receives the process end signals from the all participating one or more satellites 4, the main control CPU 80 rotates the rotatable portion 20 so that the ball receiving part 23 in which the ball 11 is received is located at the front of the first outlet portion 33, and then finishes the process. If the main control CPU 80 does not receive the process end signals from the all participating one or more satellites 4, the process proceeds to step S2 to carry out next one roulette game.

Figure 18:
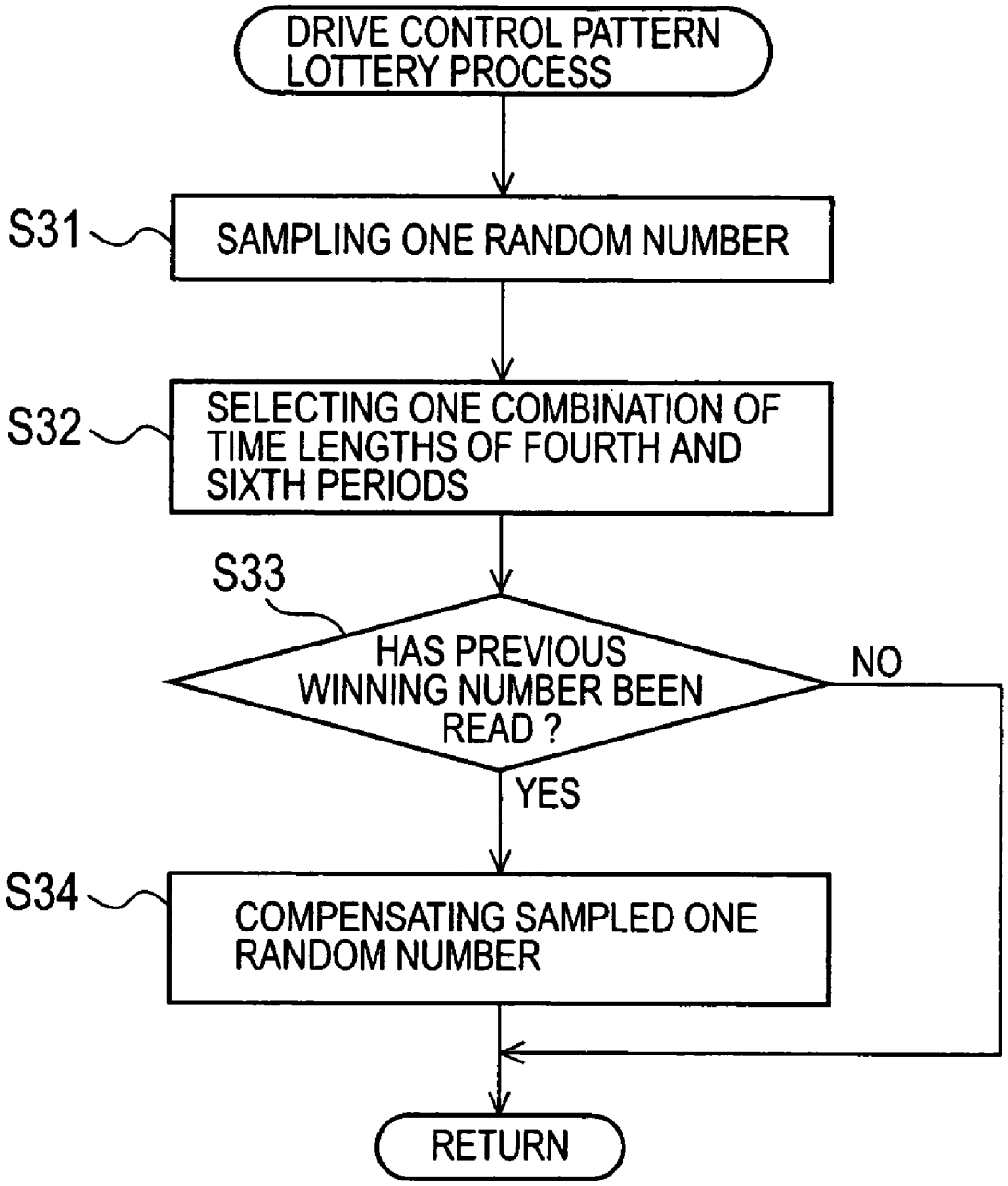
FIG. 18 is a flow chart of a drive control pattern lottery process program according to the exemplary embodiment of the present invention.

Next, the drive control pattern lottery process to be carried out in step S4 will be described with reference to FIG. 18.

In step S31, the main control CPU 80 causes the random number sampling circuit 86 to sample one random number among the random numbers sequentially generated within the range of "0" to "37", in a certain sampling period. In step S32, the main control CPU 80 selects one combination of time lengths of the fourth and sixth periods T4, T6 among the thirty-eight combinations on the basis of the sampled one random number and the rotation period lottery table 99. For example, if the sampled one random number is equal to "32", the main control CPU 80 selects one combination of the time length "0.776 sec" of the fourth period T4 and the time length "4.500 sec" of the sixth period T6. If the sampled one random number is equal to "7", the main control CPU 80 selects one combination of the time length "4.156 sec" of the fourth period T4 and the time length "1.120 sec" of the sixth period T6.

In step S33, the main control CPU 80 determines whether or not the winning number in the previous roulette game has been read from the winning number memory area of the RAM 82 in step S3. If the winning number in the previous roulette game is read, the process proceeds to step S34. If the winning number in the previous roulette game is not read, the process proceeds to step S5. In step S34, the main control CPU 80 compensates the sampled one random number, with reference to the member arrangement table and the winning number in the previous roulette game. The main control CPU 80 first identifies one numeral assigned to the ball receiving part 23 opposed to the identification sensor 57, by means of the identification sensor 57. Next, the main control CPU 80 calculates the positional relation between one numeral assigned to the ball receiving part 23 opposed to the first outlet portion 33 and the previous winning number, with reference to the identified one numeral and the member arrangement table. When the main control CPU 80 identifies the previous winning number as 1-th numeral ($0 \leqq 1 \leqq 38$) from one numeral assigned to the ball receiving part 23 opposed to the first outlet portion 33 in the anticlockwise direction of the number identification part 24, the main control CPU 80 adds "1" to the sampled random number and then identifies the added random number as a compensation random number. If the added random number is more than "37", the main control CPU 80 subtracts "38" from the added random number and then identifies the subtracted random number as a compensation random number. Then, the main control CPU 80 sets values corresponding to the compensation random number in the rotation period lottery table 99 to time lengths of the fourth and sixth periods T4, T6. Here, it is noted that the identified positional relation is employed in step S6. When the values are set, the process proceeds to step S5.

Next, advantageous features of the roulette gaming machine 1 will be described hereinafter.

In the roulette gaming machine 1, time lengths of the fourth and sixth periods T4, T6 are varied in each roulette game according to the compensation random number and the rotation period lottery table 99. More specifically, one random number is sampled among the random numbers sequentially generated within the range of "0" to "37". Then, the sampled random number is compensated according to the positional relation between one numeral assigned to the ball receiving part 23 opposed to the first outlet portion 33 and the previous number. If the main control CPU 80 identifies the previous winning number as 1-th numeral ($0 \leqq 1 \leqq 38$) from the one numeral in the anticlockwise direction of the rotatable portion 20, the main control CPU 80 adds "1" to the sampled random number. The rotatable portion 20 rotates by extra "1" ball receiving part(s) 23 in the anticlockwise direction thereof during the fourth and sixth periods T4, T6. Therefore, in a case where the random number generating circuit 85 is a pseudo random number generating circuit, even if skilled players obtain the previous winning number, the tendency for random numbers to be generated by the random number generating circuit 85, and the fourth and sixth periods T4, T6 corresponding to each random number in each roulette game, they can not roughly predict a next winning number because they need to additionally know the arrangement of the rotatable portion 20 after the ball 11 is received in one of the ball receiving parts 23 in the previous roulette game.

As a result of the compensation, the arrangement of the rotatable portion 20 at the time of stopping the rotation of the rotatable portion 20 depends on randomness in the current roulette game and chaos in the previous roulette game. It is noted that the randomness is caused when the random number generating circuit 85 sequentially generates random numbers and the chaos is caused when the ball 11 rolls on the roulette board 12. The tendency for random numbers is therefore disturbed by the chaos caused in the previous roulette game. On the other hand, in the conventional roulette gaming machine, since the compensation is not carried out, the arrangement of the rotatable portion at the time stopping the rotation of the rotatable portion depends on only randomness caused when the random number generating circuit sequentially generates random numbers in the current roulette. The tendency for random numbers therefore remains.

Since the total time length of the fourth and sixth periods T4, T6 is fixed, the variation of the drive control pattern does not influence the total control of the roulette gaming machine 1.

In the roulette gaming machine 1, the main control CPU 80 rotates the rotatable portion 20 so that the ball receiving part 23 in which the ball 11 is received is located at the front of the first outlet portion 33 when the roulette game process is finished. Therefore, the arrangement of the rotatable portion 20 is reset at the time of finishing the roulette game process.

In the roulette gaming machine 1, the ball 11 can be launched from one of the ball receiving parts 23 and received into one of the ball receiving parts 23 by adjusting air pressure to be discharged from the first outlet potion 33 and the second outlet portions 36. Therefore, the roulette gaming machine 1 needs not complicate mechanisms for launching the ball 11 from one of the ball receiving parts 23 and collecting the ball 11 received in one of the ball receiving parts 23 because the ball 11 is not collected from the roulette board 12. As a result, this can facilite the maintenance work of the roulette gaming machine 1 and reduce the cost of the roulette gaming machine 1.

In the roulette gaming machine 1, a collecting device for the ball 11 and a launching device for the ball 11 are not mounted. Therefore, the value of the depth L of the ball receiving part 23 with respect to the bottom surface of the ball receiving part 23 is smaller than the value of the diameter D of the ball 11. Thereby, the height h and the oblique angle $\alpha$ of the roulette board 12 can be smaller and larger than those of the conventional roulette board, respectively (see FIG. 5). As a result, this allows participating players to easily identify the ball 11 received in the ball receiving part 23 from every angle, during a roulette game.

In the roulette gaming machine 1, the oblique angle $\alpha$ of the first slope surface 28B is equal to that of the second slope surface 28A. Thereby, the ball 11 is launched and smoothly rolls toward the bank passage 29 on the whole slope surface 28.

In the roulette gaming machine 1, the rotatable portion 20 is only rotated with respect to the center fixed portion 22. This reduces the load of the driving motor 34.

In the roulette gaming machine 1, the bank passage 29 has the upper wall 31. This prevents the rolling ball 11 from getting out of the bank passage 29.

Next, modified examples of the present exemplary embodiment will be described hereinafter.

The time lengths of various periods may be varied instead of varying those of the fourth and sixth periods, under the condition that the total time length of the first to seventh periods is fixed.

The ball 11 may be launched by using a physical contact means such as a solenoid, instead of the compressed air from the first outlet portion 33.

The air pass hole 35 may be formed into another shape instead of the circular shape.

The roulette device 2 may have a sub-control CPU connected to the ball detecting sensor 44, the identification sensor 57 and the rotation sensor 58 and a ROM storing the member arrangement table therein, in order to determine the winning number and the positional relation between one numeral assigned to the ball receiving part 23 opposed to the first outlet portion 33 and the previous winning number.

The arrangement of the rotatable portion 20 may be not reset at the time of finishing the roulette game process.

The random number generating circuit 85 may generate random numbers depending on the arrangement of the rotatable portion 20 at the time of stopping the rotation of the rotatable portion 20 after the ball 11 is received in one of the ball receiving parts 23 in the previous roulette game. This more surely prevents skilled players from roughly predicting a next winning number.

It is noted that, besides those already mentioned above, many modifications and variations of the present exemplary embodiments may be made without departing from the novel and advantageous features of the present invention. Accordingly, all such modifications and variations are intended to be included within the scope of the appended claims.

What is claimed is:

1. A roulette gaming machine comprising:

a roulette board;

a ball for rolling on the roulette board;

a rotatable portion having an annular shape and rotatably provided at a center portion of the roulette board;

a plurality of ball receiving parts configured to receive the ball and circularly-arranged on an inner periphery side of the rotatable portion;

a plurality of marks circularly-arranged on an outer periphery side of the rotatable portion, the plurality of marks being opposed to the plurality of ball receiving parts respectively;

a bank passage provided on an outer periphery of the roulette board and on which the ball rolls along a circumferential orbit;

a driving unit configured to rotate the rotatable portion in a certain direction;

a random number generating circuit configured to generate a pseudo random number;

a selecting unit configured to select one drive control pattern among a plurality of drive control patterns for the driving unit according to the pseudo random number generated by the random number generating circuit;

a ball launching unit being opposed to at least one of the ball receiving parts and configured to launch the ball received in the at least one of the ball receiving parts; and a rotation period variation control unit configured to vary a plurality of constant speed rotation periods for rotating the rotatable portion at a plurality of rotation speeds different from each other according to the one drive control pattern after the rotatable portion stops rotating in a previous roulette game and before the ball launching unit launches the ball received in the at least one of the ball receiving parts in a current roulette game, and then control the driving unit according to the varied plurality of constant speed rotation periods and the plurality of rotation speeds, wherein when a ball receiving part in which the ball is received in the previous roulette game is located apart from a ball receiving part opposed to the ball launching unit by n ball receiving parts ($0 \leqq n$) in the certain direction, the rotation period variation control unit compensates the varied plurality of constant speed rotation periods without changing a total period of the varied plurality of constant speed rotation periods, and then controls the driving unit such that the rotatable portion rotates by extra n ball receiving parts in the certain direction during the total period after the ball receiving part in which the ball is received is opposed to the ball launching unit in the current roulette game.

2. A method for selecting a plurality of constant speed rotation periods for rotating at a plurality of rotation speeds different from each other a rotatable portion having a plurality of ball receiving parts configured to receive a ball launched by a ball launching unit being opposed to at least one of the ball receiving parts and configured to launch the ball received in the at least one of the ball receiving parts in a roulette gaming machine, the method comprising:

reading a previous winning number;

generating a pseudo random number;

selecting the plurality of constant speed rotation periods period according to the generated pseudo random number after the rotatable portion stops rotating in a previous roulette game and before the ball launching unit launches the ball received in the at least one of the ball receiving parts in a current roulette game; and compensating, when a ball receiving part to which the previous winning number is assigned is located apart from a ball receiving part opposed to the ball launching unit by n ball receiving parts ($0 \leqq n$) in a certain direction, the selected plurality of constant speed rotation periods without changing a total period of the selected plurality of constant speed rotation periods such that the rotatable portion rotates by extra n ball receiving parts in the certain direction during the total period after the ball receiving part in which the ball is received is opposed to the ball launching unit in the current roulette game.

3. The method according to claim 1, further comprising:

varying the plurality of constant speed rotation periods according to one drive control pattern selected among a plurality of drive control patterns, the one drive control pattern selected according to the generated pseudo random number; and controlling a driving unit according to the varied plurality of constant speed rotation periods and the plurality of rotation speeds, the driving unit configured to rotate the rotatable portion in the certain direction.

4. The method according to claim 3, wherein the varying occurs after the rotatable portion stops rotating in the previous roulette game and before the ball launching unit launches the ball received in the at least one of the ball receiving parts in the current roulette game.

5. The method according to claim 3, wherein the varying occurs after the selecting.

6. The method according to claim 3, wherein the controlling comprises the compensating.

7. The method according to claim 3, wherein the selected plurality of constant speed rotation periods comprises the varied plurality of constant speed rotation periods.

8. The method according to claim 3, wherein the driving unit is controlled such that the rotatable portion rotates by extra n ball receiving parts in the certain direction during the total period after the ball receiving part in which the ball is received is opposed to the ball launching unit in the current roulette game.

9. A roulette gaming machine comprising:

a roulette board;

a ball for rolling on the roulette board;

a rotatable portion having an annular shape and rotatably provided at a center portion of the roulette board;

a plurality of ball receiving parts configured to receive the ball and circularly-arranged on an inner periphery side of the rotatable portion;

a driving unit configured to rotate the rotatable portion in a certain direction;

a random number generating circuit configured to generate a pseudo random number;

a selecting unit configured to select one drive control pattern among a plurality of drive control patterns for the driving unit according to the pseudo random number generated by the random number generating circuit;

a ball launching unit being opposed to at least one of the ball receiving parts and configured to launch the ball received in the at least one of the ball receiving parts; and a rotation period variation control unit configured to vary a plurality of constant speed rotation periods for rotating the rotatable portion at a plurality of rotation speeds different from each other according to the one drive control pattern after the rotatable portion stops rotating in a previous roulette game and before the ball launching unit launches the ball received in the at least one of the ball receiving parts in a current roulette game, and then control the driving unit according to the varied plurality of constant speed rotation periods and the plurality of rotation speeds, wherein when a ball receiving part in which the ball is received in the previous roulette game is located apart from a ball receiving part opposed to the ball launching unit by n ball receiving parts ($0 \leqq n$) in the certain direction, the rotation period variation control unit compensates the varied plurality of constant speed rotation periods without changing a total period of the varied plurality of constant speed rotation periods, and then control the driving unit such that the rotatable portion rotates by extra n ball receiving parts in the certain direction during the total period after the ball receiving part in which the ball is received is opposed to the ball launching unit in the current roulette game.

10. The roulette gaming machine according to claim 9, further comprising a plurality of marks circularly-arranged on an outer periphery side of the rotatable portion, the plurality of marks being opposed to the plurality of ball receiving parts respectively.

11. The roulette gaming machine according to claim 9, further comprising a bank passage provided on an outer periphery of the roulette board and on which the ball rolls along a circumferential orbit.

* * * * *